US009121382B2

(12) United States Patent
Yamada

(10) Patent No.: US 9,121,382 B2
(45) Date of Patent: Sep. 1, 2015

(54) ENGINE STARTER WITH IMPROVED FIXING STRUCTURE OF AUXILIARY ELECTROMAGNETIC SWITCH

(75) Inventor: Kazuo Yamada, Nagoya (JP)

(73) Assignee: DENSO CORPORATION, Kariya (JP)

( * ) Notice: Subject to any disclaimer, the term of this patent is extended or adjusted under 35 U.S.C. 154(b) by 977 days.

(21) Appl. No.: 13/024,755

(22) Filed: Feb. 10, 2011

(65) Prior Publication Data

US 2011/0198862 A1 Aug. 18, 2011

(30) Foreign Application Priority Data

Feb. 18, 2010 (JP) ..... 2010-033919

(51) Int. Cl.
*F02N 11/00* (2006.01)
*F02N 11/08* (2006.01)
*F02N 15/00* (2006.01)

(52) U.S. Cl.
CPC ..... *F02N 11/087* (2013.01); *F02N 15/006* (2013.01); *F02N 2250/02* (2013.01)

(58) Field of Classification Search
CPC .. F02N 11/087; F02N 15/006; F02N 2250/02
USPC ... 290/38 R, 38 A, 38 C, 37 R, 33; 74/6, 7 B; 310/68 R; 335/131, 126; 123/185.5, 123/179.25
See application file for complete search history.

(56) References Cited

U.S. PATENT DOCUMENTS 5,720,247 A * 2/1998 Suzuki et al. ..... 123/179.25
6,150,735 A * 11/2000 Hisamoto ..... 307/10.6
6,927,953 B2 * 8/2005 Ikeda ..... 361/23
7,579,710 B2 * 8/2009 Hisamoto et al. ..... 307/10.6
8,305,169 B2 * 11/2012 Suzuki et al. ..... 335/126
2003/0214766 A1 11/2003 Hisamoto et al.
2008/0162007 A1 * 7/2008 Ishii et al. ..... 701/54
2009/0020093 A1 * 1/2009 Kaneda et al. ..... 123/179.25
2009/0206965 A1 * 8/2009 Niimi ..... 335/106
2011/0140813 A1 * 6/2011 Suzuki et al. ..... 335/156

FOREIGN PATENT DOCUMENTS

CN 1169508 A 1/1998
CN 2539976 Y 3/2003

(Continued)

OTHER PUBLICATIONS

Jul. 31, 2012 Office Action issued in Chinese Patent Application No. 201110042064.4 (with translation).

(Continued)

*Primary Examiner* — Julio Gonzalez Ramirez
(74) *Attorney, Agent, or Firm* — Oliff PLC

(57) ABSTRACT

Disclosed is a starter for starting an engine. The starter includes a starter main body, a main electromagnetic switch, and an auxiliary electromagnetic switch. The starter main body includes a motor that generates torque upon being supplied with electric power. The main electromagnetic switch is provided for selectively opening and closing an electric circuit for supplying electric power from a battery to the motor. The auxiliary electromagnetic switch is provided for selectively switching the electric circuit between a high-resistance path and a low-resistance path. The starter is characterized in that the auxiliary electromagnetic switch is fixed to a fixture, and the fixture is fixed to only one of the starter main body and the main electromagnetic switch.

14 Claims, 17 Drawing Sheets

(56) References Cited

FOREIGN PATENT DOCUMENTS

| | | | |
|---|---|---|---|
| CN | 201031750 | Y | 3/2008 |
| CN | 101514665 | A | 8/2009 |
| EP | 2 080 897 | A2 | 7/2009 |
| EP | 2080897 | A2 * | 7/2009 |
| EP | 2093786 | A1 | 8/2009 |
| FR | 2783020 | A1 | 3/2000 |
| JP | Y2-56-4843 | | 2/1981 |
| JP | U-62-191353 | | 12/1987 |
| JP | A-8-74793 | | 3/1996 |
| JP | A-2009-167967 | | 7/2009 |
| JP | A-2009-185760 | | 8/2009 |
| JP | A-2009-224315 | | 10/2009 |

OTHER PUBLICATIONS

Japanese Office Action issued in Japanese Application No. 2010-033919, mailed Aug. 20, 2013 (with partial translation).

Feb. 16, 2015 Office Action issued in Chinese Application No. 201310303140.1.

Mar. 3, 2015 Written Opinion issued in French Application No. FR1151304.

* cited by examiner

ENGINE STARTER WITH IMPROVED FIXING STRUCTURE OF AUXILIARY ELECTROMAGNETIC SWITCH

CROSS-REFERENCE TO RELATED APPLICATION

This application is based on and claims priority from Japanese Patent Application No. 2010-33919, filed on Feb. 18, 2010, the content of which is hereby incorporated by reference in its entirety into this application.

BACKGROUND OF THE INVENTION

1. Technical Field of the Invention

The present invention relates to engine starters which include a motor that generates torque for starting an engine, a main electromagnetic switch for selectively opening and closing an electric circuit for supplying electric power from a battery to the motor, and an auxiliary electromagnetic switch for selectively switching the electric circuit between a high-resistance path and a low-resistance path.

2. Description of the Related Art

Conventionally, a starter for starting an internal combustion engine generally includes a motor that generates torque for starting the engine and an electromagnetic switch that selectively opens and closes an electric circuit for supplying electric power from a battery to the motor.

However, when activation of the motor is started, in other words, when the electric circuit is closed by the electromagnetic switch, a large current, which is generally called inrush current, flows from the battery to the motor. Consequently, the terminal voltage of the battery drops rapidly and thereby may cause an instantaneous power failure to occur. Here, the term instantaneous power failure denotes a phenomenon in which electric devices other than the motor which are powered by the battery instantaneously stop operating due to the rapid drop in the terminal voltage of the battery.

Moreover, due to the large current, the motor will generate a high torque, thereby increasing the impact force between a pinion of the starter and a ring gear of the engine during the establishment of engagement therebetween. Consequently, wear of the pinion and the ring gear will increase, thereby lowering durability of the starter and the engine. In addition, a high level of noise will be generated during the establishment of engagement between the pinion and the ring gear.

To solve the above problems, there is disclosed, for example in Japanese Patent Application Publications No. 2009-224315 and No. 2009-167967, a technique of selectively switching the electric circuit for supplying electric power from the battery to the motor between a high-resistance path and a low-resistance path.

Specifically, according to the technique, a resistor is inserted in the electric circuit to form both the high-resistance and low-resistance paths. Along the high-resistance path, electric power is supplied from the battery to the motor through the resistor. On the other hand, along the low-resistance path, electric power is supplied from the battery to the motor bypassing (i.e., without passing through) the resistor. Further, an auxiliary electromagnetic switch is employed to switch the electric circuit between the high-resistance and low-resistance paths.

More specifically, when activation of the motor is started, the auxiliary electromagnetic switch switches the electric circuit to the high-resistance path, causing only a limited current, which is limited by the resistor, to be supplied from the battery to the motor. Consequently, the terminal voltage of the battery is prevented from rapidly dropping. As a result, it is possible to prevent an instantaneous power failure from occurring, thereby ensuring normal operation of the other electric devices powered by the battery. Moreover, with the limited current, the motor will generate only a limited torque, thereby reducing the impact force between the pinion of the starter and the ring gear of the engine when establishing engagement therebetween. As a result, wear of the pinion and the ring gear will be suppressed, thereby improving durability of the starter and the engine. In addition, it is possible to suppress the level of noise generated during the establishment of engagement between the pinion and the ring gear.

As soon as the pinion and the ring gear are fully engaged, the auxiliary electromagnetic switch switches the electric circuit to the low-resistance path, thereby allowing the full voltage of the battery to be applied to the motor. Consequently, with the full voltage applied, the motor will rotate at a high speed to start the engine.

In addition, in recent years, the use of engine automatic stop/restart systems (also called idle stop systems) has been increasing in order to reduce global warming. For a starter used in an engine automatic stop/restart system, the number of times the starter operates to start or restart the engine is considerably increased; thus, it is necessary for the starter to have high durability. Accordingly, the above-described technique is particularly effective when applied to starters used in engine automatic stop/restart systems.

Moreover, according to the disclosure of Japanese Patent Application Publications No. 2009-224315 and No. 2009-167967, the auxiliary electromagnetic switch is fixed to a housing of the starter via a bracket.

More specifically, the housing has a switch-mounting portion to which the main electromagnetic switch is fixed by means of two bolts. The bracket has first and second end portions. The first end portion has an end surface to which the auxiliary electromagnetic switch is joined by, for example, welding. The second end portion has two through-holes formed therein. The second end portion is interposed between the switch-mounting portion of the housing and the main electromagnetic switch and fixed therebetween by fastening the two bolts which respectively pass through the through-holes of the second end portion.

However, with the above fixing structure, the auxiliary electromagnetic switch is fixed to the bracket and the bracket is fixed to both the housing of the starter and the main electromagnetic switch. In other words, it is necessary to fix the bracket along with the auxiliary electromagnetic switch not only to the housing of the starter but also to the main electromagnetic switch. Consequently, flexibility in fixing the auxiliary electromagnetic switch in the starter is lowered, thus also lowering flexibility in mounting the starter with respect to the engine.

SUMMARY OF THE INVENTION

According to the present invention, there is provided a starter for starting an engine. The starter includes a starter main body, a main electromagnetic switch, and an auxiliary electromagnetic switch. The starter main body includes a motor that generates torque upon being supplied with electric power. The main electromagnetic switch is provided for selectively opening and closing an electric circuit for supplying electric power from a battery to the motor. The auxiliary electromagnetic switch is provided for selectively switching the electric circuit between a high-resistance path and a low-resistance path. Along the high-resistance path, electric power is supplied from the battery to the motor through a resistor. On the other hand, along the low-resistance path, electric power is supplied from the battery to the motor bypassing the resistor. The starter is characterized in that the auxiliary electromagnetic switch is fixed to a fixture, and the fixture is fixed to only one of the starter main body and the main electromagnetic switch.

Consequently, without fixing the fixture along with the auxiliary electromagnetic switch to both the starter main body and the main electromagnetic switch, flexibility in fixing the auxiliary electromagnetic switch in the starter is improved, thus also improving flexibility in mounting the starter with respect to the engine.

BRIEF DESCRIPTION OF THE DRAWINGS

The present invention will be understood more fully from the detailed description given hereinafter and from the accompanying drawings of preferred embodiments of the invention, which, however, should not be taken to limit the invention to the specific embodiments but are for the purpose of explanation and understanding only.

In the accompanying drawings.

DESCRIPTION OF PREFERRED EMBODIMENTS

Figure 1:
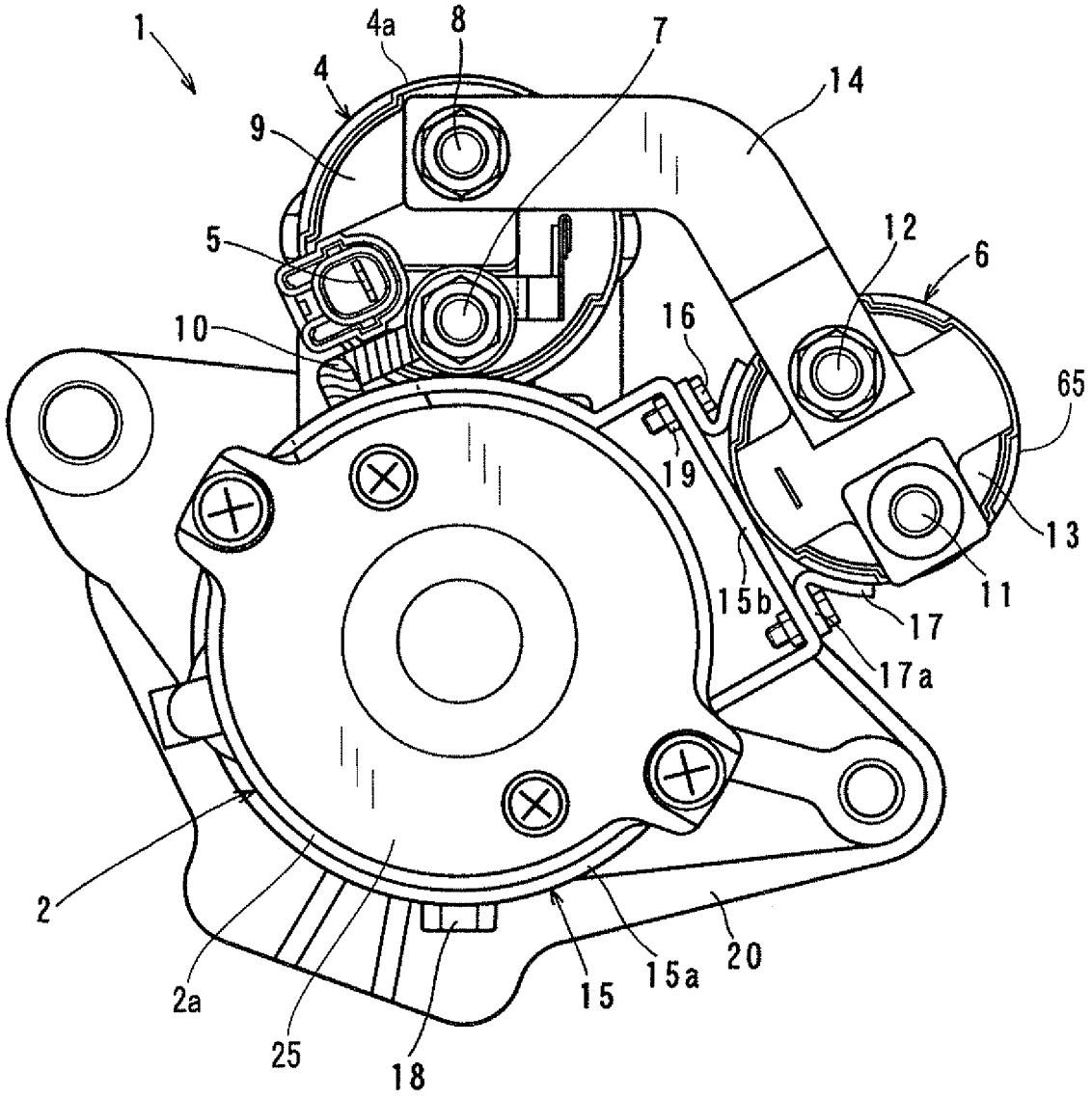
FIG. 1 is a rear end view of a starter according to the first embodiment of the invention.

Preferred embodiments of the present invention will be described hereinafter with reference to FIGS. 1-18. It should be noted that for the sake of clarity and understanding, identical components having identical functions in different embodiments of the invention have been marked, where possible, with the same reference numerals in each of the figures and that for the sake of avoiding redundancy, descriptions of the identical components will not be repeated.

[First Embodiment]

Figure 2:
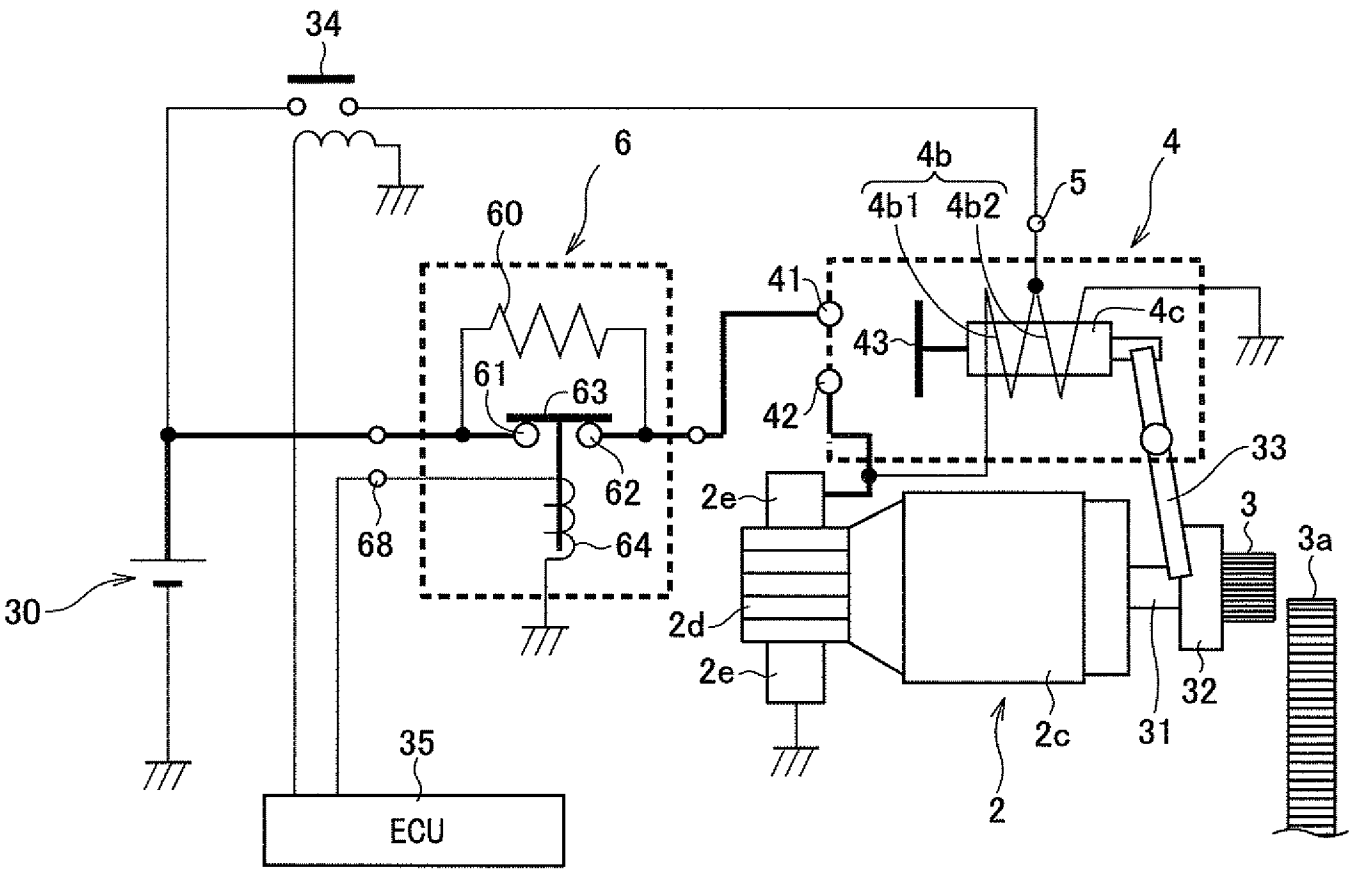
FIG. 2 is a schematic circuit diagram of the starter.

FIGS. 1 and 2 together show the overall configuration of a starter 1 according to the first embodiment of the invention. The starter 1 is designed to start an internal combustion engine of a motor vehicle.

As shown in FIGS. 1 and 2, the starter 1 includes: a motor 2 that generates torque upon being supplied with electric power; a pinion 3 that is configured to mesh with a ring gear 3*a* of the engine to transmit the torque generated by the motor 2 to the engine; a shift lever 33 that is configured to shift the pinion 3 in the axial direction of the starter 1 to bring the pinion 3 into and out of mesh with the ring gear 3*a*; a main electromagnetic switch 4 that selectively opens and closes an electric circuit for supplying electric power from a battery 30 to the motor 2 (to be simply referred to as motor circuit hereinafter); an auxiliary electromagnetic switch 6 that switches the motor circuit between a high-resistance path and a low-resistance path; and a resistor 60 that is inserted in the motor circuit so as to form both the high-resistance and low-resistance paths.

The motor 2 is implemented by a commutator motor of a well-known type in the art. More specifically, the motor 2 includes: a hollow cylindrical yoke 2*a* for forming a magnetic circuit; a field 2*b* (not shown) arranged on the radially inner periphery of the yoke 2*a*; an armature 2*c* surrounded by the field 2*b* to generate torque; a commutator 2*d* provided on a rear end portion (i.e., the left end portion in FIG. 2) of the armature 2*c*; and a pair of positive-side and negative-side brushes 2*e* that are arranged around the radially outer periphery of the commutator 2*d* to make sliding contact with the commutator 2*d* during rotation of the armature 2*c*; and an end frame 25 that closes a rear open end of the yoke 2*a*. In operation, upon closing the motor circuit, electric power is supplied from the battery 30 to the armature 2*c* via the sliding contact between the commutator 2*d* and the brushes 2*e*, causing the armature 2*c* to rotate.

The pinion 3 is provided together with a clutch 32 on an output shaft 31 which is driven by the motor 2, so that rotation of the output shaft 31 is transmitted to the pinion 3 via the clutch 32.

The main electromagnetic switch 4 is fixed to a housing 20 of the starter 1 by means of two through-bolts (not shown).

The main electromagnetic switch 4 includes a cylindrical cup-shaped yoke 4*a*, solenoid coils 4*b*, a plunger 4*c*, a pair of fixed contacts 41 and 42 that make up main contacts of the motor circuit, a movable contact 43, a pair of terminal bolts 7 and 8, and a contact cover 9.

The solenoid coils 4*b* are received in the yoke 4*a* and create, when energized, a magnetic attraction for the plunger 4*c*. The magnetic attraction causes the plunger 4*c* to move to close the main contacts of the motor circuit. Further, when the solenoid coils 4*b* are deenergized, the magnetic attraction disappears. Then, the plunger 4*e* is returned, by the elastic force of a return spring (not shown), to its initial position, thereby opening the main contacts of the motor circuit.

The fixed contact 41 is electrically connected to the high voltage-side (i.e., the side of the battery 30) via the terminal bolt 8. On the other hand, the fixed contact 42 is electrically connected to the low voltage-side (i.e., the side of the motor 2) via the terminal bolt 7.

The movable contact 43 is configured to move along with the plunger 4*c* to connect (or bridge) and disconnect (or separate) the pair of fixed contacts 41 and 42. More specifically, when the movable contact 43 makes contact with both the fixed contacts 41 and 42 to connect them, the main contacts of the motor circuit is closed. Moreover, when the movable contact 43 is detached from both the fixed contacts 41 and 42 to disconnect them, the main contacts are opened.

The contact cover 9 is made of resin and covers the fixed contacts 41 and 42 and the movable contact 43. More specifically, the contact cover 9 has the shape of a cylindrical cup and has its open end inserted in the yoke 4*a* of the main electromagnetic switch 4 so as to close the open end of the yoke 4*a*. Further, the contact cover 9 is fixed to the yoke 4*a* by crimping all or part of the circumference of an open end portion of the yoke 4*a* onto the contact cover 9.

Both the terminal bolts 7 and 8 are fixed to the contact cover 9 via, for example, washers. More specifically, each of the terminal bolts 7 and 8 has a head portion located inside the contact cover 9 and a male-threaded shaft portion protruding outside the contact cover 9. The head portions of the terminal bolts 7 and 8 are respectively electrically connected to the fixed contacts 42 and 41. The shaft portion of the terminal bolt 7 is electrically connected to the positive-side brush 2*e* of the motor 2 via a lead 10. On the other hand, the shaft portion of the terminal bolt 8 is electrically connected to the auxiliary electromagnetic switch 6.

Moreover, in the present embodiment, the solenoid coils 4*b* of the main electromagnetic switch 4 include a pull-in coil 4*b*1 and a hold-on coil 4*b*2. The pull-in coil 4*b*1 has one end electrically connected to an energization terminal 5 that is fixed to the contact cover 9, and the other end electrically connected to the terminal bolt 7. The hold-on coil 4*b*2 has one end electrically connected to the energization terminal 5 and the other end grounded.

The energization terminal 5 is, as shown in FIG. 2, electrically connected to the battery 30 via a starter relay 34. In operation, when the starter relay 34 is turned on by an ECU 35, electric current is supplied from the battery 30 to the energization terminal 5, thereby energizing the solenoid coils 4*b*. Here, the ECU 35 is an ECU (Electronic Control Unit) for controlling operation of the engine.

Figure 3:
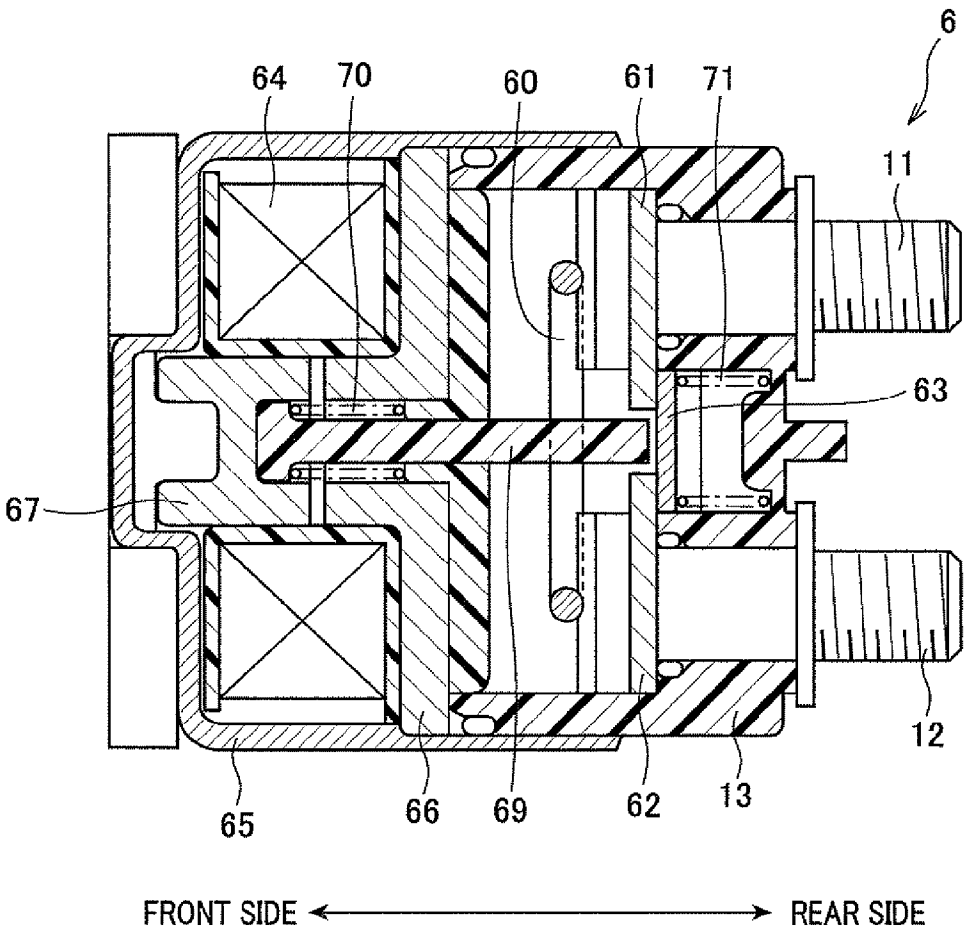
FIG. 3 is a partially cross-sectional view of an auxiliary electromagnetic switch of the starter.

Referring now to FIG. 3, the auxiliary electromagnetic switch 6 includes: a cylindrical cup-shaped yoke 65; a solenoid coil 64 received in the yoke 65; a fixed core 66 to be magnetized upon energization of the solenoid coil 64; a movable core 67 that is disposed on the front side of the fixed core 66 to face it in the axial direction of the auxiliary electromagnetic switch 6; a resin-made contact cover 13 that is disposed on the rear side of the fixed core 66 to close the open end of the yoke 65; a pair of terminal bolts 11 and 12 fixed to the contact cover 13; a pair of fixed contacts 61 and 62 that are respectively electrically connected to the terminal bolts 11 and 12; and a movable contact 63 that connects (or bridges) and disconnects (or separates) the fixed contacts 61 and 62.

The yoke 65 forms, together with the fixed core 66, a magnetic circuit (or a fixed magnetic path) of the auxiliary electromagnetic switch 6.

The solenoid coil 64 has one end electrically connected to an energization terminal 68 (shown in FIG. 2) and the other end grounded. The energization terminal 68 is fixed to the contact cover 13 and electrically connected to the ECU 35.

The movable core 67 is coupled to a resin-made rod 69 so as to be movable in the axial direction of the auxiliary electromagnetic switch 6 together with the rod 69. In addition, the rod 69 is urged forward by a return spring 70.

The contact cover 13 has the shape of a cylindrical cup with a circular open end. The contact cover 13 is assembled to the yoke 65 so that a front end portion of the contact cover 13 is fitted into a rear end portion of the yoke 65. Further, the contact cover 13 is fixed to the yoke 65 by crimping all or part of the circumference of the rear end portion of the yoke 65 onto the front end portion of the contact cover 13.

Both the terminal bolts 11 and 12 are fixed to the contact cover 13 via, for example, washers. More specifically, each of the terminal bolts 11 and 12 has a head portion located inside the contact cover 13 and a male-threaded shaft portion protruding outside the contact cover 13. The head portions of the terminal bolts 11 and 12 are respectively electrically connected to the fixed contacts 61 and 62. The shaft portion of the terminal bolt 11 is electrically connected to the cathode of the battery 30. On the other hand, the shaft portion of the terminal bolt 12 is both electrically and mechanically connected to the shaft portion of the terminal bolt 8 of the main electromagnetic switch 4 via a metal connecting member 14 (shown in FIG. 1).

The fixed contacts 61 and 62 are both received in the contact cover 13 and make up auxiliary contacts of the motor circuit.

The movable contact 63 is also received in the contact cover 13. The movable contact 63 is located on the rear side of the fixed contacts 61 and 62 and urged forward by a contact pressure spring 71.

In the present embodiment, the auxiliary electromagnetic switch 6 is configured as a normally-closed switch. More specifically, when the solenoid coil 64 is not energized, the contact pressure spring 71 applies a forward pressure to the movable contact 63, thereby pressing the movable contact 63 on the fixed contacts 61 and 62. Consequently, as shown in FIG. 3, the fixed contacts 61 and 62 are connected by the movable contact 63, and thus the auxiliary electromagnetic switch 6 is closed. Moreover, when energized by the ECU 35, the solenoid coil 64 creates a magnetic attraction together with the fixed core 66. The magnetic attraction attracts the movable core 67 to move backward along with the rod 69, thereby causing the rod 69 to push the movable contact 63 backward against the elastic force of the contact pressure spring 71. Consequently, the fixed contacts 61 and 62 are disconnected from each other, and thus the auxiliary electromagnetic switch 6 is opened.

The resistor 60 is received in the contact cover 13 of the auxiliary electromagnetic switch 6. The resistor 60 has one end both electrically and mechanically connected to the head portion of the terminal bolt 11 and the other end both electrically and mechanically connected to the head portion of the terminal bolt 12. Consequently, as shown in FIG. 2, in the motor circuit, the resistor 60 is electrically connected between the auxiliary contacts 61 and (i.e., the fixed contacts 61 and 62 of the auxiliary electromagnetic switch 6).

With the above arrangement of the resistor 60, the low-resistance path is formed when the solenoid coils 4*b* are energized to close the main electromagnetic switch 4 and the solenoid coil 64 is not energized and thus the auxiliary electromagnetic switch 6 is kept closed. Along the low-resistance path, electric power is supplied from the battery 30 to the motor 2 via the fixed contacts 61 and 62 of the auxiliary electromagnetic switch 6 which are connected by the movable contact 63 and the fixed contacts 41 and 42 of the main electromagnetic switch 4 which are connected by the movable contact 43, bypassing the resistor 60. On the other hand, the high-resistance path is formed when the solenoid coils 4*b* are energized to close the main electromagnetic switch 4 and the solenoid coil 64 is energized to open the auxiliary electromagnetic switch 6. Along the high-resistance path, electric power is supplied from the battery 30 to the motor 2 via the resistor 60 and the fixed contacts 41 and 42 of the main electromagnetic switch 4 which are connected by the movable contact 43. In addition, when the solenoid coils 4*b* are not energized and thus the main electromagnetic switch 4 is kept open, the motor circuit is opened and thus no electric power is supplied from the battery 30 to the motor 2.

Next, operation of the starter 1 according to the present embodiment will be described.

First, at a timing t1, the ECU 35 energizes the solenoid coil 64 of the auxiliary electromagnetic switch 6. Upon being energized, the solenoid coil 64 creates a magnetic attraction together with the fixed core 66. The magnetic attraction attracts the movable core 67 to push backward along with the rod 69, thereby causing the rod 69 to move the movable contact 63 backward against the elastic force of the contact pressure spring 71. Consequently, the fixed contacts 61 and 62 are disconnected from each other, and the auxiliary electromagnetic switch 6 is thus opened.

Then, at a timing t2, the ECU 35 turns on the starter relay 34, causing electric current to flow from the battery 30 to the solenoid coils 4*b* of the main electromagnetic switch 4 to energize them. Upon being energized, the solenoid coils 4*b* create the magnetic attraction which attracts the plunger 4*c* to move in the leftward direction of FIG. 2, thereby causing the movable contact 43 to connect the fixed contacts 41 and 42 and the shift lever 33 to shift the pinion 3 rightward.

Consequently, the motor circuit is closed and only a limited current, which is limited by the resistor 60, flows from the battery 30 to the motor 2 along the high-resistance path. As a result, the motor 2 rotates at a low speed, facilitating the establishment of engagement between the pinion 3 and the ring gear 3*a* of the engine.

After the engagement between the pinion 3 and the ring gear 3*a* has been established, at a timing t3, the ECU 35 deenergizes the solenoid coil 64 of the auxiliary electromagnetic switch 6, causing the magnetic attraction created by the solenoid coil 64 to disappear. Consequently, the movable core 67 and the rod 69 are returned, by the elastic force of the return spring 70, to their respective initial positions. At the same time, the movable contact 63 is returned, by the elastic force of the contact pressure spring 71, to its initial position, thereby connecting the fixed contacts 61 and 62 again.

As a result, the motor circuit is switched to the low-resistance path along which a full current flows from the battery 30 to the motor 2. With the full current, the motor 2 rotates at a high speed. Further, the torque generated by the motor 2 is transmitted to the engine via the engagement between the pinion 3 and the ring gear 3*a*, thereby starting the engine.

As soon as the engine has started, at a timing t4, the ECU 35 deenergizes the solenoid coils 4*b* of the main electromagnetic switch 4, causing the magnetic attraction created by the solenoid coils 4*b* to disappear. Consequently, the plunger 4*c* of the main electromagnetic switch 4 is returned, by the elastic force of the return spring (not shown), to its initial position, thereby causing the movable contact 43 to disconnect the fixed contacts 41 and 42 and the shift lever 33 to return the initial position thereof.

As a result, the motor circuit is opened to interrupt the electric power supply from the battery 30 to the motor 2, thereby causing the motor 2 to stop. At the same time, the pinion 3 is brought out of mesh with the ring gear 3*a* of the engine.

After having described the overall configuration and operation of the starter 1, the fixing structure of the auxiliary electromagnetic switch 6 according to the present embodiment will be described hereinafter.

In the present embodiment, as shown in FIG. 1, the auxiliary electromagnetic switch 6 is fixed to the yoke 2*a* of the motor 2 via a fixture (or fixing member) that is implemented by a fixing band 15.

Figure 4:
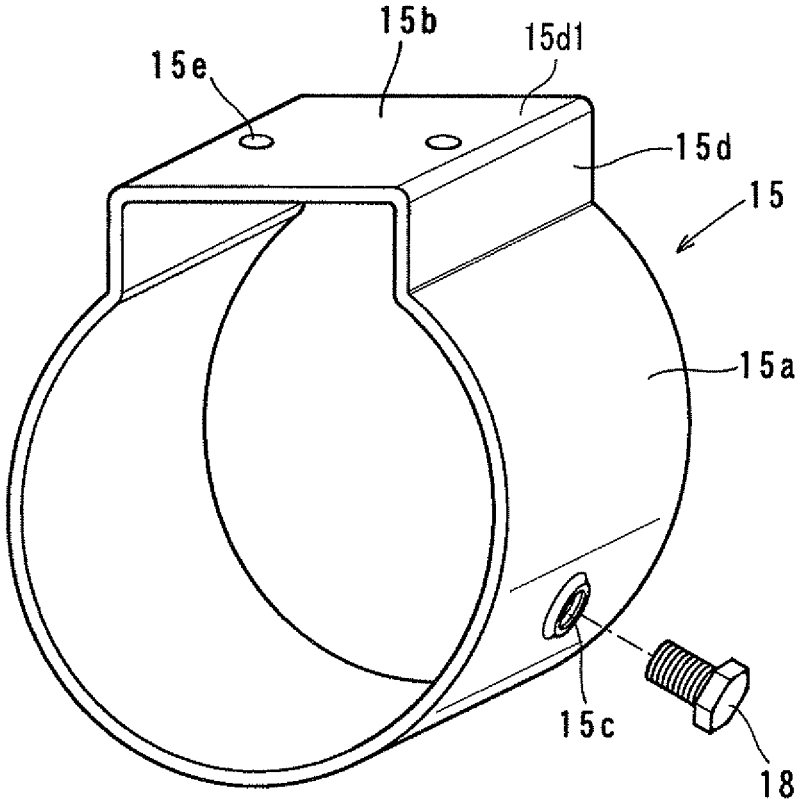
FIG. 4 is a perspective view of a fixing band according to the first embodiment for fixing the auxiliary electromagnetic switch.

Referring to FIG. 4, the fixing band 15 is configured to include a band portion 15*a* and a seat portion 15*b* that is integrally formed with the band portion 15*a*.

The band portion 15*a* has the shape of an incomplete hollow cylinder with an opposite pair of circumferential ends. The band portion 15*a* also has an inside diameter slightly greater than the outside diameter of the hollow cylindrical yoke 2*a* of the motor 2. Hereinafter, the yoke 2*a* of the motor 2 will be simply referred to as motor yoke 2*a*.

Moreover, the band portion 15*a* has at least one tapped hole (or female-threaded hole) 15*c* that is formed through the circumferential wall of the band portion 15*a* by burring. In addition, though only one tapped hole 15*c* is shown in FIG. 4 for the sake of simplicity, it is preferable that the band portion 15*a* has two or more tapped holes 15*c*.

The seat portion 15*b* has a pair of side walls 15*d* and an end wall 15*d*1. The side walls 15*d* are spaced from each other by a predetermined distance and protrude radially outward respectively from the circumferential ends of the band portion 15*a*. The end wall 15*d*1 extends to connect the radially outer ends of the side walls 15*d* and has a flat outer surface.

Moreover, the seat portion 15*b* has a plurality (e.g., 2 in FIG. 4) of circular through-holes 15*e* that are formed through the end wall 15*d*1 of the seat portion 15*b*.

On the other hand, the auxiliary electromagnetic switch 6 has, as shown in FIG. 1, a pair of brackets 17 joined to the radially outer surface of the yoke 65 by, for example, welding.

Each of the brackets 17 is formed by shaping a rectangular metal plate (e.g., iron plate). More specifically, each of the brackets 17 is bent to have first and second portions. The first portion extends along and is joined to the radially outer surface of the yoke 65 of the auxiliary electromagnetic switch 6. The second portion protrudes from the radially outer surface of the yoke 65 to make up a supporting foot 17*a*. The supporting feet 17*a* of the brackets 17 extend parallel to each other so as to fall on the same plane. Moreover, each of the supporting feet 17*a* of the brackets 17 has at least one circular through-hole that is formed at a position corresponding to the position of one of the through-holes 15*e* formed in the seat portion 15*b* of the fixing band 15.

The auxiliary electromagnetic switch 6 is fixed to the motor yoke 2*a* in the following way.

First, the fixing band 15 is placed so that the band portion 15*a* of the fixing band 15 surrounds the radially outer surface of the motor yoke 2*a*. Then, referring to FIG. 5, a bolt 18 is tightened into the tapped hole 15*c* formed in the band portion 15*a* of the fixing band 15, until the front end of the bolt 18 becomes pressed against the radially outer surface of the motor yoke 2*a*. Consequently, the fixing band 15 is fixed to the motor yoke 2*a* via the bolt 18.

Next, the supporting feet 17*a* of the brackets 17 are placed on the seat portion 15*b* of the fixing band 15 so that each of the through-holes formed in the supporting feet 17*a* aligns with one of the through-holes 15*e* formed in the seat portion 15*b*. Thereafter, for each aligned pair of the through-holes of the supporting feet 17*a* and the through-holes 15*e* of the seat portion 15*b*, a bolt 16 is placed to extend through the pair of the through-holes, and then a nut 19 (shown in FIG. 1) is tightened onto the bolt 16. Consequently, the supporting feet 17*a* of the brackets 17 are fixed to the seat portion 15*b* of the fixing band 15 via the engagement between the bolts 16 and the nuts 19. Thus, the auxiliary electromagnetic switch 6, which has the brackets 17 joined thereto, is accordingly fixed to the fixing band 15.

As a result, the auxiliary electromagnetic switch 6 is fixed to the motor yoke 2*a* via the fixing band 15.

According to the present embodiment, it is possible to achieve the following advantages.

In the present embodiment, the starter 1 includes the main electromagnetic switch 4, the auxiliary electromagnetic switch 6, and a starter main body which includes components of the starter 1 other than the main and auxiliary electromagnetic switches 4 and 6, such as the motor 2 and the pinion 3. The auxiliary electromagnetic switch 6 is fixed to the fixing band 15 and the fixing band 15 is fixed to only one of the starter main body and the main electromagnetic switch 4. More specifically, in the present embodiment, the fixing band 15 is fixed to only the motor yoke 2*a*.

Consequently, without fixing the fixing band 15 along with the auxiliary electromagnetic switch 6 to both the starter main body and the main electromagnetic switch 4, flexibility in fixing the auxiliary electromagnetic switch 6 in the starter 1 is improved, thus also improving flexibility in mounting the starter 1 with respect to the engine.

Moreover, in the present embodiment, the fixing band 15 is configured to include the band portion 15*a* and the seat portion 15*b*. The band portion 15*a* is disposed to surround the radially outer periphery of the motor yoke 2*a* and fixed to the radially outer surface. The seat portion 15*b* has the auxiliary electromagnetic switch 6 fixed to the outer surface of the end wall 15*d*1.

With the above configuration of the fixing band 15, it is possible to fix the auxiliary electromagnetic switch 6 to the motor yoke 2*a* via the fixing band 15 without altering the design of the motor yoke 2*a*. Moreover, it is also possible to change, according to the mounting condition of the starter 1, the position of the auxiliary electromagnetic switch 6 in the circumferential direction of the motor yoke 2*a* by rotating the band portion 15*a* in the circumferential direction. Consequently, flexibility in fixing the auxiliary electromagnetic switch 6 in the starter 1 and thus flexibility in mounting the starter 1 with respect to the engine are further improved.

Further, in the present embodiment, the band portion 15*a* of the fixing band 15 has an inside diameter greater than the outside diameter of the motor yoke 2*a* and at least one tapped hole 15*c* formed through the circumferential wall of the band portion 15*a*. The band portion 15*a* is fixed to the radially outer surface of the motor yoke 2*a* by tightening the bolt 18 into the tapped hole 15*c* to press the bolt 18 against the radially outer surface of the motor yoke 2*a*.

With the above configuration, it is possible to easily fix the fixing band 15 along with the auxiliary electromagnetic switch 6 to the radially outer surface of the motor yoke 2*a* without forming any additional hole in the motor yoke 2*a*. Moreover, when the outside diameter of the motor yoke 2*a* is changed due to a change in the design specification of the starter 1, it is still possible to fix the fixing band 15 along with the auxiliary electromagnetic switch 6 to the radially outer surface of the motor yoke 2*a* only by simply changing the inside diameter of the band portion 15*a*.

In addition, in the present embodiment, the at least one tapped hole 15*c* of the band portion 15*a* of the fixing band 15 is formed by burring.

Consequently, it is possible to reliably form the at least one tapped hole 15*c* even with a smaller thickness of the band portion 15*a*. In other words, it is possible to minimize the thickness of the band portion 15*a* while ensuring reliable formation of the tapped hole 15*c*.

Furthermore, in the present embodiment, the auxiliary electromagnetic switch 6 includes the brackets 17 each of which is bent to have the first and second portions. The first portion extends along and is joined to the radially outer surface of the yoke 65 of the auxiliary electromagnetic switch 6. The second portion protrudes from the radially outer surface of the yoke 65 to make up the supporting foot 17*a*. Each of the supporting feet 17*a* of the brackets 17 is disposed on the outer surface of the end wall 15*d*1 of the seat portion 15*b* of the fixing band 15 and fixed to the outer surface by means of the engagement between the bolt 16 and the nut 19.

With the above configuration, it is possible to easily and reliably fix the auxiliary electromagnetic switch 6 to the seat portion 15*b* of the fixing band 15.

In the present embodiment, the yoke 65 and the cover contact 13 of the auxiliary electromagnetic switch 6 together make up a housing of the auxiliary electromagnetic switch 6. Moreover, the resistor 60 is arranged within the housing so as to be electrically connected between the fixed contacts 61 and 62.

With the above arrangement, it is possible to protect the resistor 60 from foreign matter, such as water, thereby improving the durability of the resistor 60. In addition, since no flammable gas can reach the resistor 60, it is possible to ensure the safety of the auxiliary electromagnetic switch 6 when the resistor 60 comes to glow after a long-time energization thereof.

Modification

In the previous embodiment, the auxiliary electromagnetic switch 6 is fixed to the fixing band 15 and the fixing band 15 is fixed to the motor yoke 2*a*.

Figure 5:
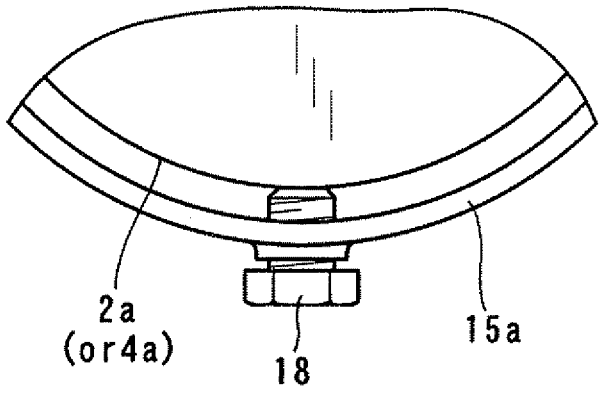
FIG. 5 is a schematic rear end view illustrating the manner of fixing the fixing band to a yoke of a motor or a yoke of a main electromagnetic switch of the starter.

However, as shown in FIG. 5, it is also possible to fix the fixing band 15, which has the auxiliary electromagnetic switch 6 fixed thereto, to the yoke 4*a* of the main electromagnetic switch 4 in the same manner as fixing it to the motor yoke 2*a*. In other words, it is also possible to fix the auxiliary electromagnetic switch 6, via the fixing band 15, to the main electromagnetic switch 4 instead of the motor 2. In this case, it is still possible to achieve the same advantages as described in the previous embodiment.

[Second Embodiment]

Figure 6:
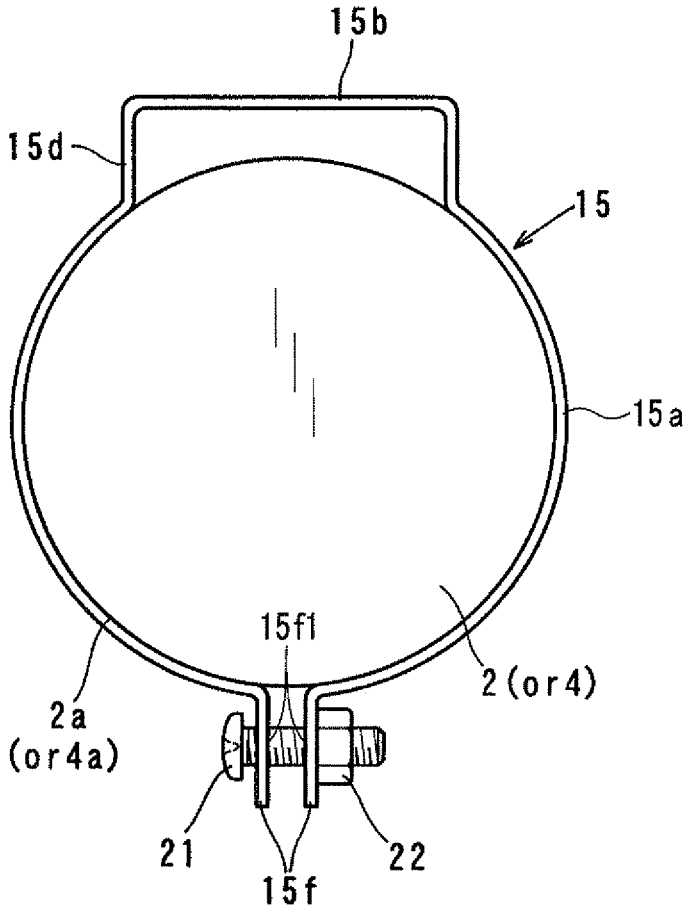
FIG. 6 is a rear end view showing a fixing band according to the second embodiment of the invention.

FIG. 6 shows the configuration of a fixing band 15 according to the second embodiment of the invention.

As shown in FIG. 6, in the present embodiment, the fixing band 15 is also configured to include a band portion 15*a* and a seat portion 15*b*.

The seat portion 15*b* is identical to the seat portion 15*b* according to the first embodiment. However, the band portion 15*a* is different from the band portion 15*a* according to the first embodiment.

More specifically, in the present embodiment, the band portion 15*b* is divided in its circumferential direction to have an opposite pair of end parts 15*f*. The end parts 15*f* are bent to extend radially outward and face each other in the circumferential direction with a gap formed therebetween. In addition, each of the end parts 15*f* has a through-hole 15*f*1 formed therein.

In fixing the fixing band 15 to the motor yoke 2*a*, the fixing band 15 is first placed so that the band portion 15*a* of the fixing band 15 surrounds the radially outer surface of the motor yoke 2*a*. Then, a bolt 21 is placed to extend through both the through-holes 15*f*1 formed in the end parts 15*f* of the band portion 15*a*. Thereafter, a nut 22 is tightened onto the bolt 21 to bring the band portion 15*a* of the fixing band 15 into intimate contact with the radially outer surface of the motor yoke 2*a*. As a result, the band portion 15*a* is firmly fixed to the motor yoke 2*a* by means of the engagement between the bolt 21 and the nut 22.

With the above configuration of the fixing band 15 according to the present embodiment, it is possible to fix the auxiliary electromagnetic switch 6 to the motor yoke 2*a* via the fixing band 15 without altering the design of the motor yoke 2*a*. Moreover, it is also possible to change, according to the mounting condition of the starter 1, the position of the auxiliary electromagnetic switch 6 in the circumferential direction of the motor yoke 2*a* by rotating the band portion 15*a* in the circumferential direction. Consequently, flexibility in fixing the auxiliary electromagnetic switch 6 in the starter 1 and thus flexibility in mounting the starter 1 with respect to the engine are improved.

Further, with the above configuration, it is possible to easily fix the fixing band 15 to the radially outer surface of the motor yoke 2*a* by fastening the end parts 15*f* of the band portion 15*a* together by means of the engagement between the bolt 21 and the nut 22. Moreover, when the outside diameter of the motor yoke 2*a* is changed due to a change in the design specification of the starter 1, it is still possible to fix the fixing band 15 along with the auxiliary electromagnetic switch 6 to the radially outer surface of the motor yoke 2*a* only by simply changing the inside diameter of the band portion 15*a*.

Furthermore, in the present embodiment, the band portion 15*a* of the fixing band 15 is brought into intimate contact with and firmly fixed to the radially outer surface of the motor yoke 2*a* by tightening the nut 22 onto the bolt 21. Consequently, it is possible to reliably prevent the band portion 15*a* from moving in the circumferential direction of the motor yoke 2*a* due to vibration transmitted thereto during running of the vehicle. Moreover, it is also possible to reliably prevent deformation of the band portion 15*a* due to the vibration even with a smaller thickness of the band portion 15*a*. In other words, it is possible to minimize the thickness of the band portion 15*a* while reliably preventing deformation of the band portion 15*a* due to vibration.

Modification

In the previous embodiment, the auxiliary electromagnetic switch 6 is fixed to the fixing band 15 and the fixing band 15 is fixed to the motor yoke 2*a*.

However, as shown in FIG. 6, it is also possible to fix the fixing band 15 to the yoke 4*a* of the main electromagnetic switch 4 in the same manner as fixing it to the motor yoke 2*a*. In this case, it is still possible to achieve the same advantages as described in the previous embodiment.

[Third Embodiment]

Figure 7:
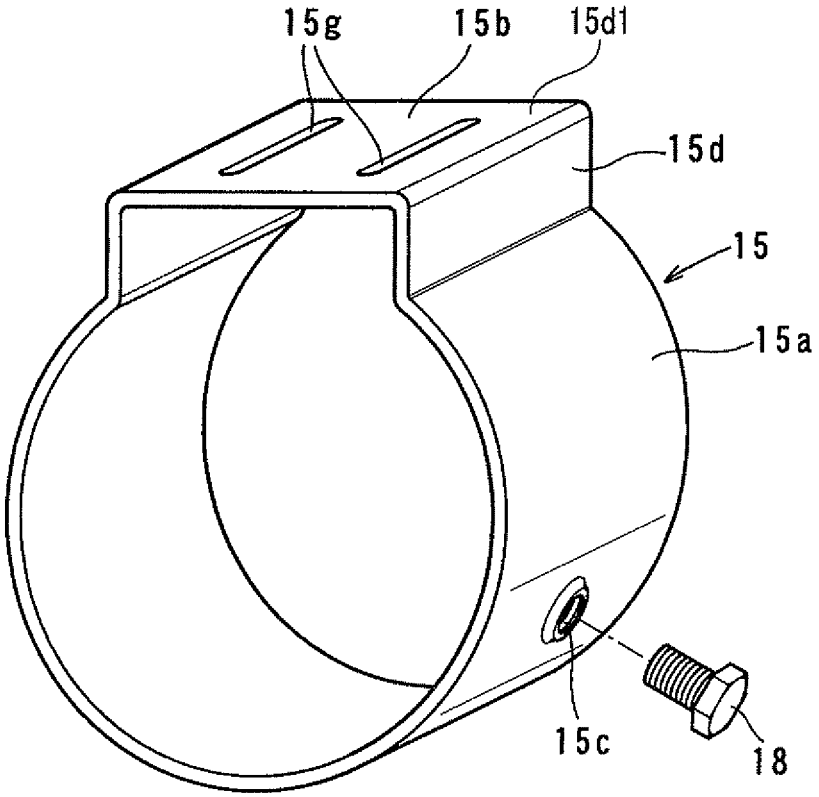
FIG. 7 is a perspective view showing a fixing band according to the third embodiment of the invention.

FIG. 7 shows the configuration of a fixing band 15 according to the third embodiment of the invention.

As shown in FIG. 7, in the present embodiment, the fixing band 15 is also configured to include a band portion 15*a* and a seat portion 15*b*.

The band portion 15*a* is identical to the band portion 15*a* according to the first embodiment; thus it can be fixed to either the motor yoke 2*a* or the yoke 4*a* of the main electromagnetic switch 4 in the same manner as described in the first embodiment.

However, the seat portion 15*b* is different from the seat portion 15*b* according to the first embodiment. Specifically, referring further to FIG. 8C, in the present embodiment, the seat portion 15*b* has a pair of slits 15*g* that are formed through the end wall 15*d*1 to extend parallel to each other with a predetermined distance therebetween.

Figure 8A:
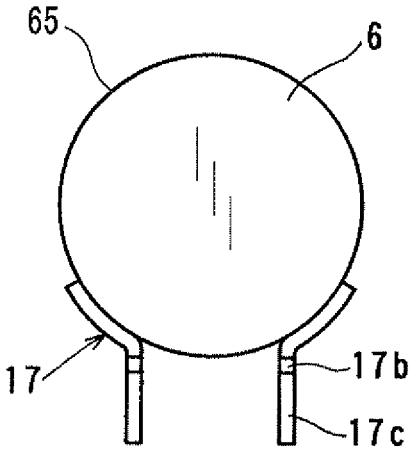
FIGS. 8A and 8B are respectively rear end and side views showing the auxiliary electromagnetic switch including brackets according to the third embodiment.
Figure 8B:
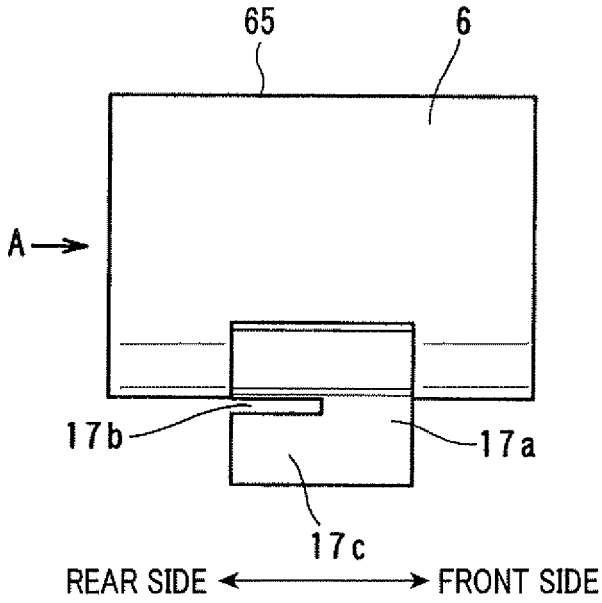
Figure 8C:
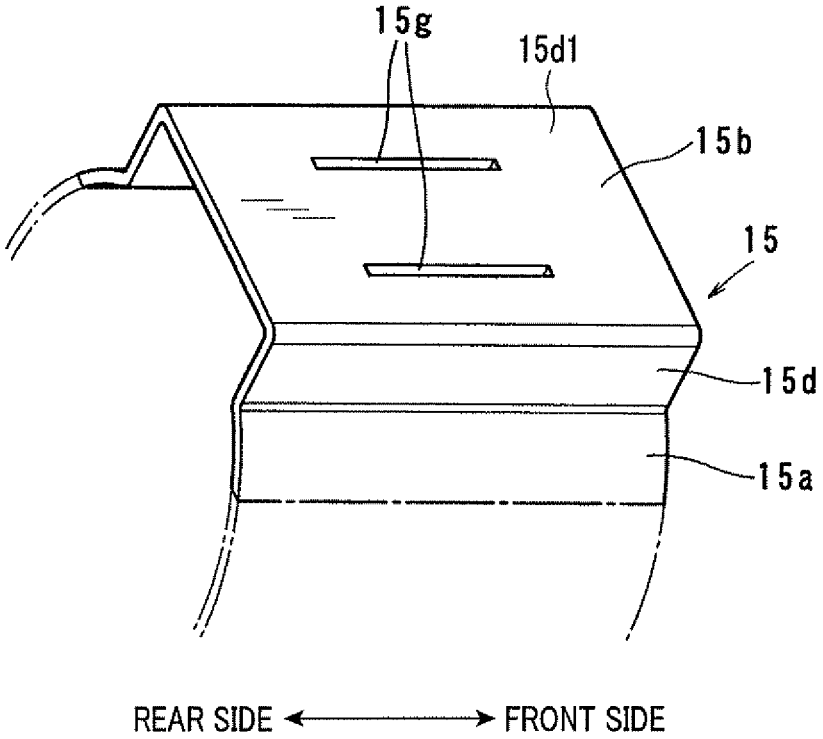
FIG. 8C is an enlarged perspective view showing slits formed in a seat portion of the fixing band according to the third embodiment.

On the other hand, the auxiliary electromagnetic switch 6 includes, as shown in FIGS. 8A-8B, a pair of brackets 17 each of which is bent to have first and second portions. The first portion extends along and is joined to the radially outer surface of the yoke 65 of the auxiliary electromagnetic switch 6. The second portion protrudes from the radially outer surface of the yoke 65 to make up a supporting foot 17*a*. The supporting feet 17*a* of the brackets 17 extend parallel to each other with a predetermined distance therebetween; the predetermined distance is substantially equal to that between the slits 15*g* formed in the seat portion 15*b* of the fixing band 15. Moreover, each of the supporting feet 17*a* has a recess 17*b* that is formed in the rear end surface of the supporting foot 17*a* with its depth direction coinciding with the axial direction of the auxiliary electromagnetic switch 6. Furthermore, each of the supporting feet 17*a* of the brackets 17 also has a protruding part 17*c* that adjoins the recess 17*b* on the opposite side to the first portion of the bracket 17. In addition, each of the recesses 17*b* formed in the supporting feet 17*a* has a width that is substantially equal to the thickness of the end wall 15*d*1 of the seat portion 15*b* of the fixing band 15.

In fixing the auxiliary electromagnetic switch 6 to the fixing band 15, each of the protruding parts 17*c* of the supporting feet 17*a* of the brackets 17 is inserted inside the end wall 15*d*1 of the seat portion 15*b* of the fixing band 15 through a corresponding one of the slits 15*g* formed through the end wall 15*d*1. Then, the auxiliary electromagnetic switch 6 is moved backward, thereby press-fitting the end wall 15*d*1 of the seat portion 15*b* of the fixing band 15 into each of the recesses 17*b* formed in the supporting feet 17*a* of the brackets 17. Consequently, both the supporting feet 17*a* of the brackets 17 are fixed to the seat portion 15*b* of the fixing band 15 by means of the press-fit between the recesses 17*b* of the supporting feet 17*a* and the end wall 15*d*1 of the seat portion 15*b*.

Figure 9:
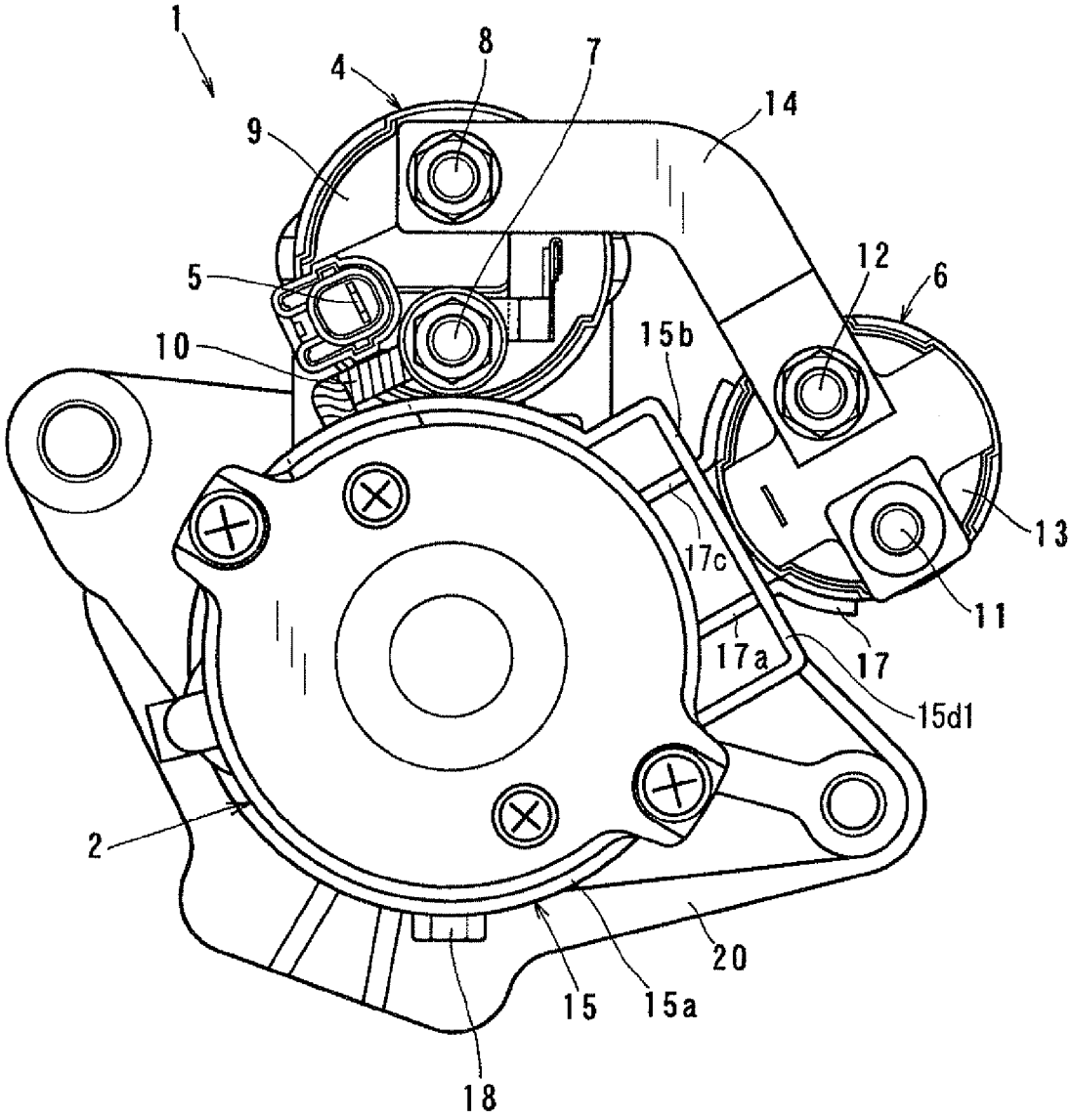
FIG. 9 is a rear end view of a starter according to the third embodiment.

As a result, the auxiliary electromagnetic switch 6 can be fixed via the fixing band 15 to, for example, the motor yoke 2*a* as shown in FIG. 9.

With the above fixing structure of the auxiliary electromagnetic switch 6 according to the present embodiment, it is possible to achieve the same advantages as with the fixing structure according to the first embodiment.

Moreover, with the above fixing structure according to the present embodiment, it is possible to easily fix each of the brackets 17 of the auxiliary electromagnetic switch 6 to the seat portion 15*b* of the fixing band 15 without using any additional fixing means, such as a bolt-nut engagement and welding.

Furthermore, since the end wall 15*d*1 of the seat portion 15*b* of the fixing band 15 is press-fitted in each of the recesses 17*b* formed in the supporting feet 17*a* of the brackets 17, it is possible to reliably prevent the brackets 17 from moving relative to the fixing band 15 due to vibration transmitted thereto during running of the vehicle.

In addition, in the present embodiment, as shown in FIG. 9, each of the supporting feet 17*a* of the brackets 17 is configured so that the protruding part 17*c* of the supporting foot 17*a*, which protrudes inside the end wall 15*d*1 of the seat portion 15*b* of the fixing band 15, is brought into pressed contact with the radially outer surface of the motor yoke 2*a* (or alternatively with the yoke 4*a* of the main electromagnetic switch). Consequently, it is possible to more reliably prevent radial movement of the auxiliary electromagnetic switch 6 relative to the motor yoke 2*a* (or alternatively to the yoke 4*a* of the main electromagnetic switch).

[Fourth Embodiment]

Figure 10:
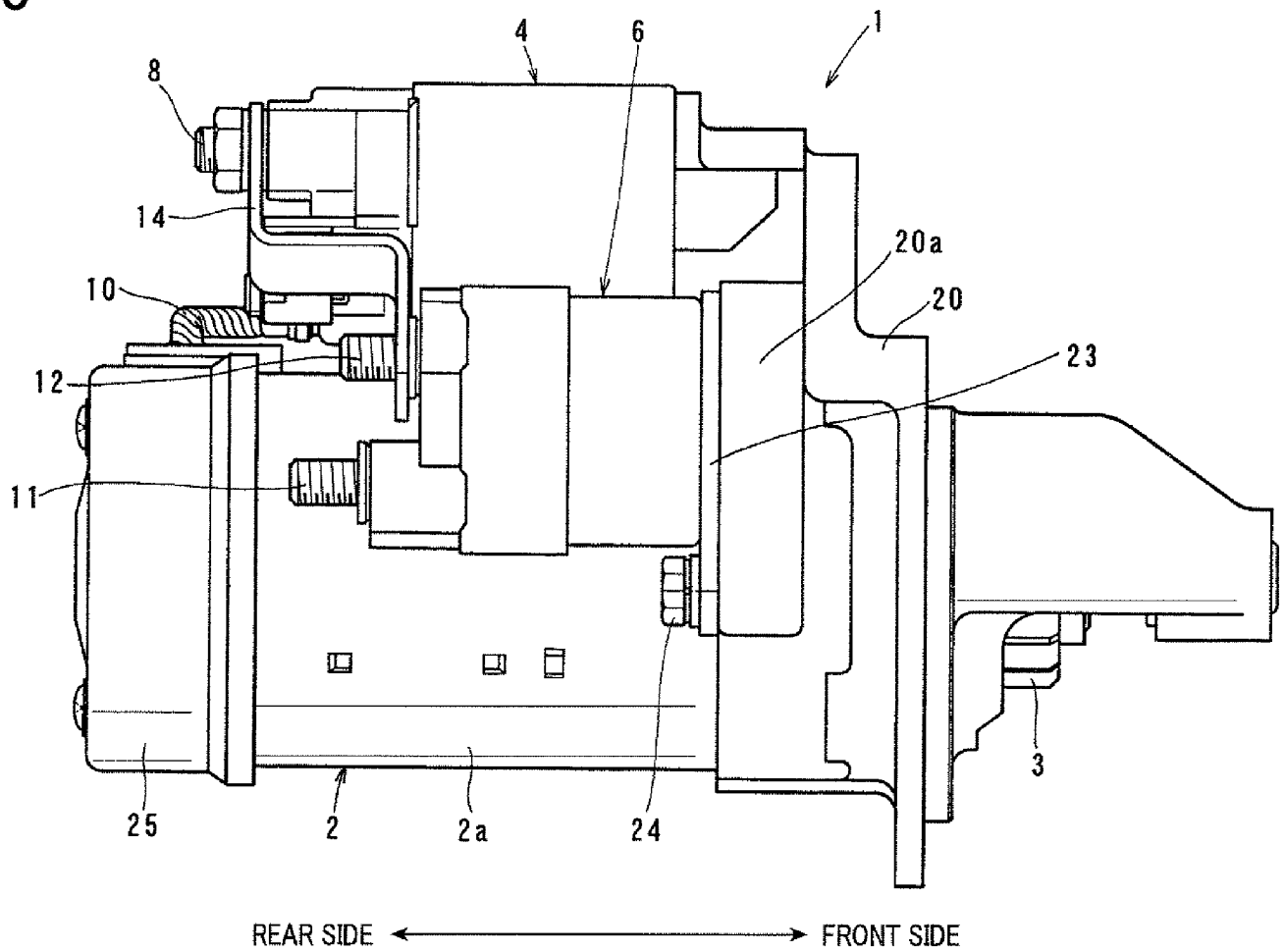
FIGS. 10 and 11 are respectively side and rear end views of a starter according to the fourth embodiment of the invention.
Figure 11:
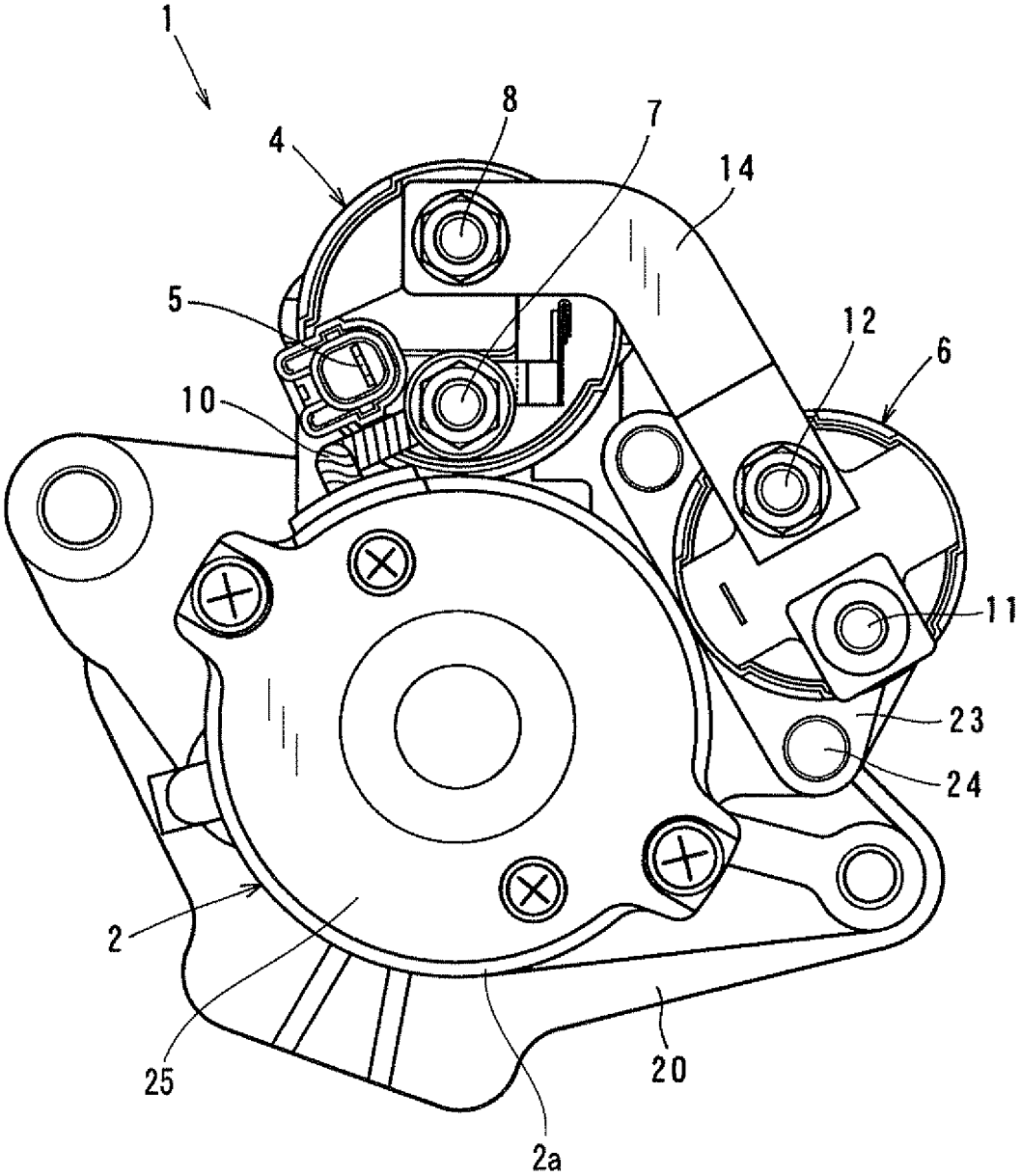

FIGS. 10 and 11 together show the overall configuration of a starter 1 according to the fourth embodiment of the invention.

As shown in FIGS. 10 and 11, in the present embodiment, the auxiliary electromagnetic switch 6 is fixed to the housing 20 of the starter 1 via a fixture that is implemented by a mount 20*a*. Further, the mount 20*a* is integrally formed with the housing 20 of the starter 1. In other words, the mount 20*a* is formed as an integral part of the housing 20. In addition, the mount 20*a* has a plurality of tapped holes (not shown) formed therein.

On the other hand, the auxiliary electromagnetic switch 6 includes a bracket 23 that is formed by shaping a metal plate (e.g., iron plate). The bracket 23 is joined, for example by welding, to the outer surface of an end wall of the cylindrical cup-shaped yoke 65 of the auxiliary electromagnetic switch 6. In addition, the bracket 23 has a plurality of through-holes (not shown) formed therein.

In fixing the auxiliary electromagnetic switch 6 to the housing 20 of the starter 1, the bracket 23 is first placed on the mount 20*a* formed in the housing 20 so that each of the through-holes of the bracket 23 is brought into alignment with one of the tapped holes of the mount 20*a*. Then, for each aligned pair of the through-holes of the bracket 23 and the tapped holes of the mount 20*a*, a bolt 24 is placed to extend through the through-hole of the bracket 23 and tightened into the tapped hole of the mount is 20*a*. Consequently, the bracket 23 is firmly fixed to the mount 20*a* by means of the engagement between the bolts 24 and the tapped holes of the mount 20*a*.

With the above fixing structure of the auxiliary electromagnetic switch 6 according to the present embodiment, it is possible to securely fix the auxiliary electromagnetic switch 6 to the housing 20 of the starter 1.

Moreover, it is possible to form the fixture (i.e., the mount 20*a*) for fixing the auxiliary electromagnetic switch 6 integrally with the housing 20 of the starter 1 by, for example, die casting. Consequently, with the integral formation of the fixture with the housing 20, the parts count of the starter 1 is reduced, thereby improving the assembly efficiency of the starter 1.

In addition, with the integral formation of the fixture with the housing 20, it is possible to effectively dissipate heat generated by the auxiliary electromagnetic switch 6 to the housing 20 which generally has a large heat capacity.

Modification

In the previous embodiment, the auxiliary electromagnetic switch 6 is fixed to the housing 20 of the starter 1 via the fixture that is implemented by the mount 20*a* formed integrally with the housing 20.

Figure 12:
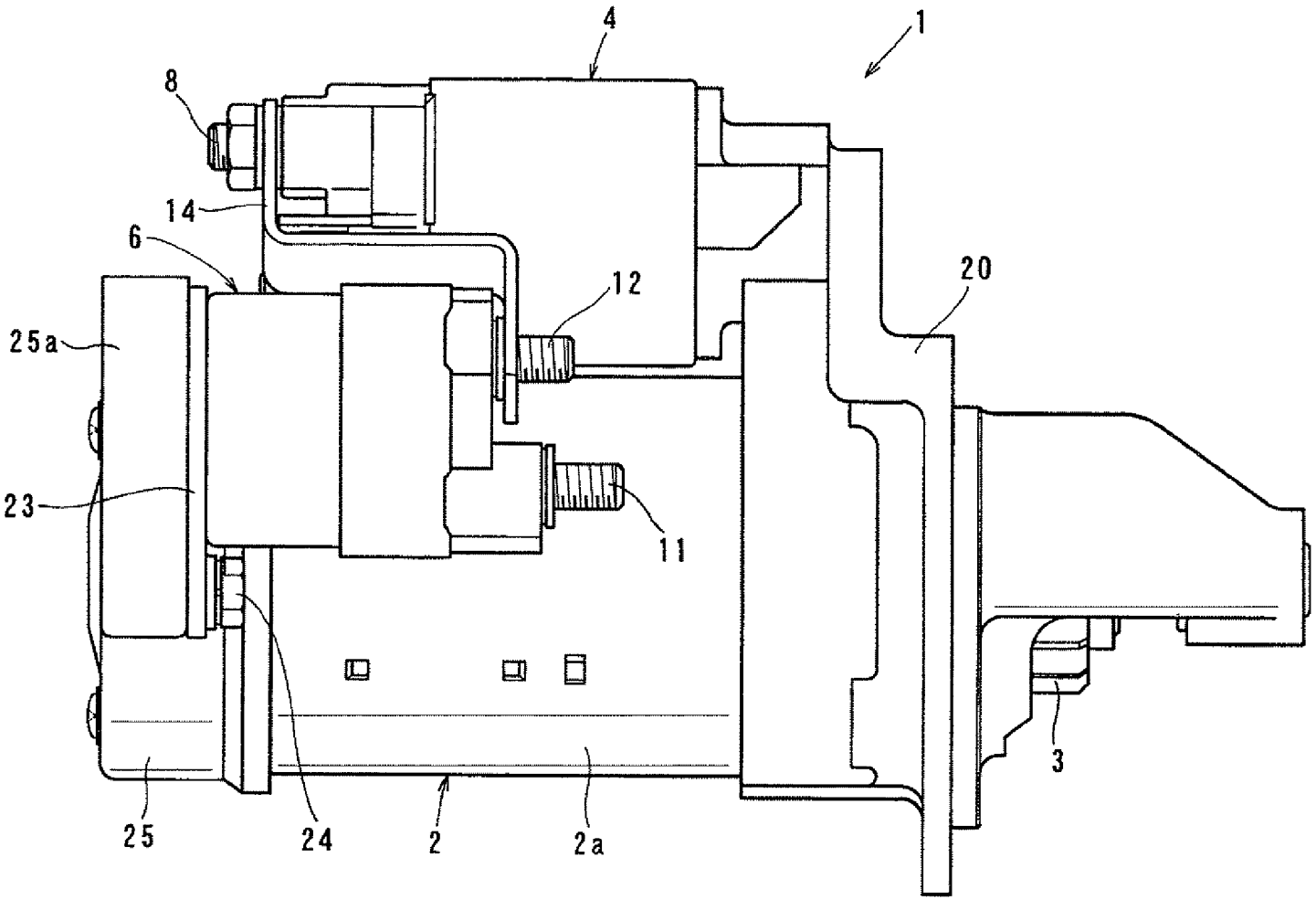
FIGS. 12 and 13 are respectively side and rear end views of a starter according to a modification of the fourth embodiment.
Figure 13:
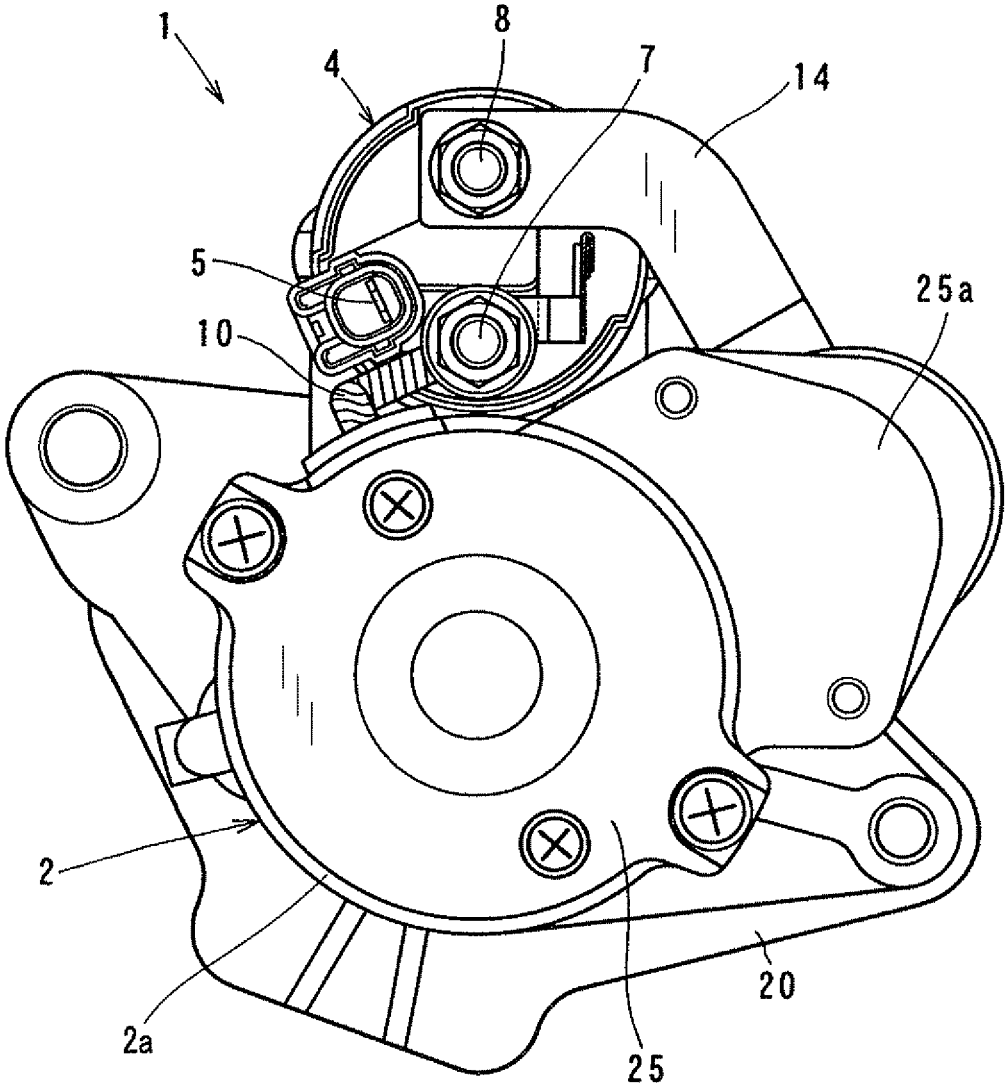

However, as shown in FIGS. 12 and 13, it is also possible to fix the auxiliary electromagnetic switch 6 to the end frame 25 of the motor 2 via a fixture that is implemented by a mount 25*a*; the mount 25*a* is integrally formed with the end frame 25. In this case, it is still possible to achieve the same advantages as described in the previous embodiment.

In addition, it is possible to fix the bracket 23 of the auxiliary electromagnetic switch 6 to the mount 25*a* in the same manner as fixing the bracket 23 to the mount 20*a* in the previous embodiment.

[Fifth Embodiment]

Figure 14:
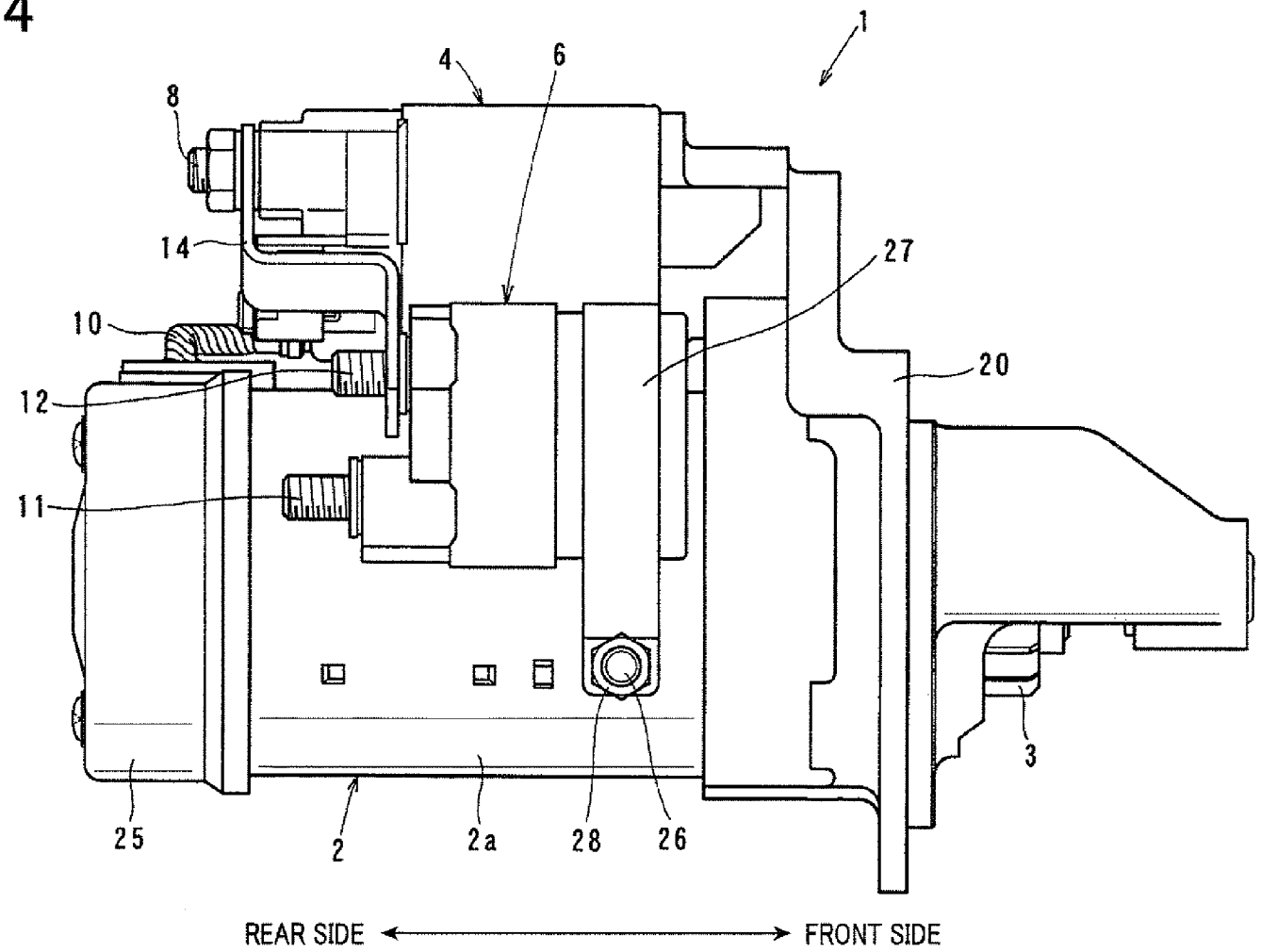
FIGS. 14 and 15 are respectively side and rear end views of a starter according to the fifth embodiment of the invention.
Figure 15:
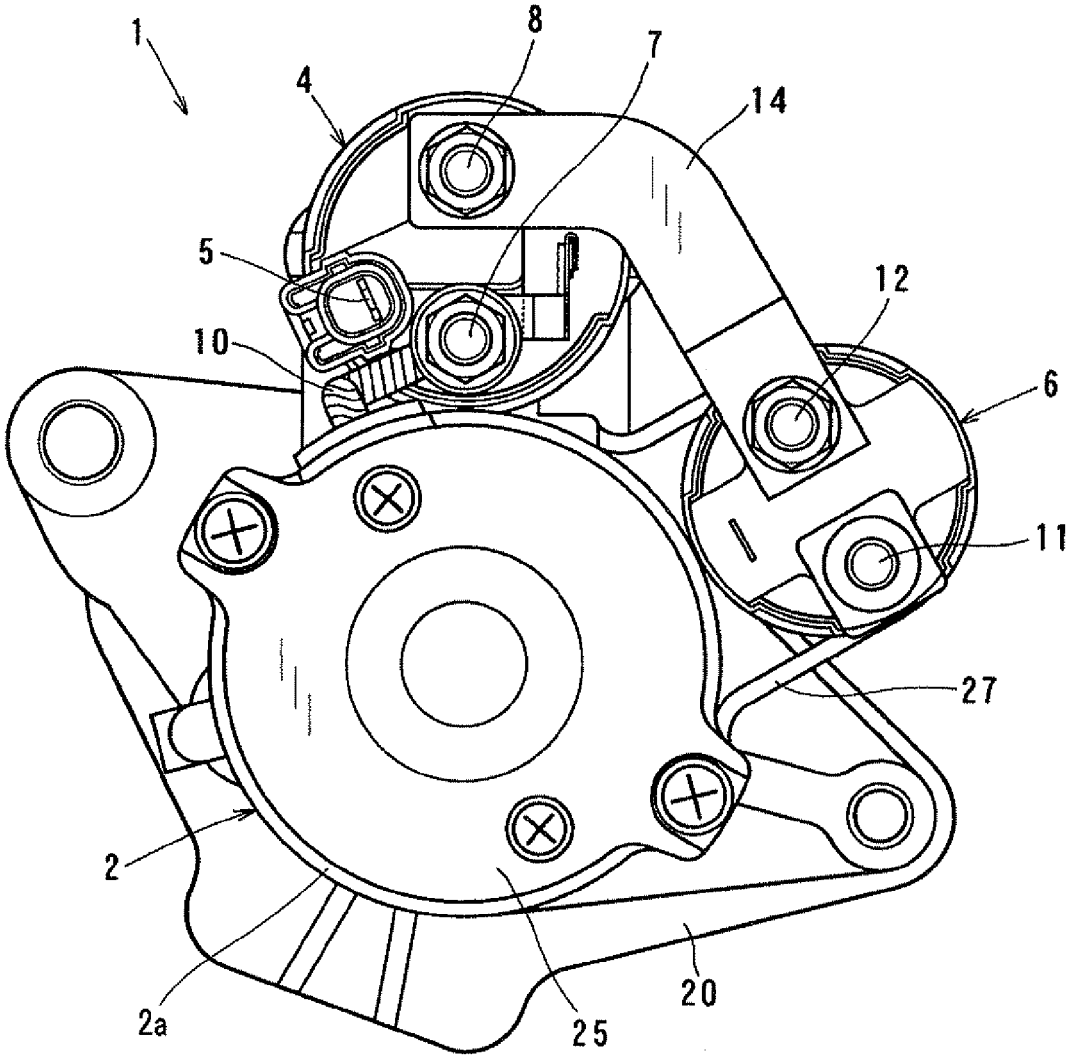

FIGS. 14 and 15 together show the overall configuration of a starter 1 according to the fifth embodiment of the invention.

As shown in FIGS. 14 and 15, in the present embodiment, the auxiliary electromagnetic switch 6 is fixed to the motor yoke 2*a* via a fixture that is implemented by a fixing band 27. The fixing band 27 has an opposite pair of end portions each of which has a through-hole (not shown) formed therein.

On the other hand, the motor yoke 2*a* includes a mount (not shown) provided on the radially outer surface of the motor yoke 2*a*. The mount has a pair of stud bolts 26 embedded therein.

In fixing the auxiliary electromagnetic switch 6 to the motor yoke 2*a*, the auxiliary electromagnetic switch 6 is first placed on the mount provided on the radially outer surface of the motor yoke 2*a*. Then, the fixing band 27 is placed to surround the radially outer surface of the yoke 65 of the auxiliary electromagnetic switch 6, and the end portions of the fixing band 27 are positioned relative to the mount so as to have each of the stud bolts 26 embedded in the mount extend through a corresponding one of the through-holes formed in the end portions. Thereafter, for each of the stud bolts 26, a nut 28 is tightened onto the stud bolt 26, thereby fixing the auxiliary electromagnetic switch 6 to the mount via the fixing band 27.

With the above fixing structure of the auxiliary electromagnetic switch 6, it is possible to easily and securely fix the auxiliary electromagnetic switch 6 to the motor yoke 2*a*.

Moreover, when the outside diameter of the yoke 65 of the auxiliary electromagnetic switch 6 is changed due to a change in the design specification of the starter 1, it is still possible to fix the auxiliary electromagnetic switch 6 to the motor yoke 2*a* via the fixing band 27 only by simply changing the inside diameter of the fixing band 27.

Furthermore, in the present embodiment, the fixing band 27 is brought into intimate contact with and firmly fixed to the radially outer surface of the yoke 65 of the auxiliary electromagnetic switch 6 by tightening the nuts 28 onto the stud bolts 26. Consequently, it is possible to reliably prevent the fixing band 27 from moving in the circumferential direction of the yoke 65 due to vibrations transmitted thereto during running of the vehicle. Moreover, it is also possible to reliably prevent deformation of the fixing band 27 due to the vibrations even with a smaller thickness of the fixing band 27. In other words, it is possible to minimize the thickness of the fixing band 27 while reliably preventing deformation of the fixing band 27 due to the vibrations.

In addition, in the present embodiment, the mount has the stud bolts 26 embedded therein, thereby facilitating the fixing of the auxiliary electromagnetic switch 6 to the motor yoke 2*a* via the fixing band 27.

Modification

Figure 16:
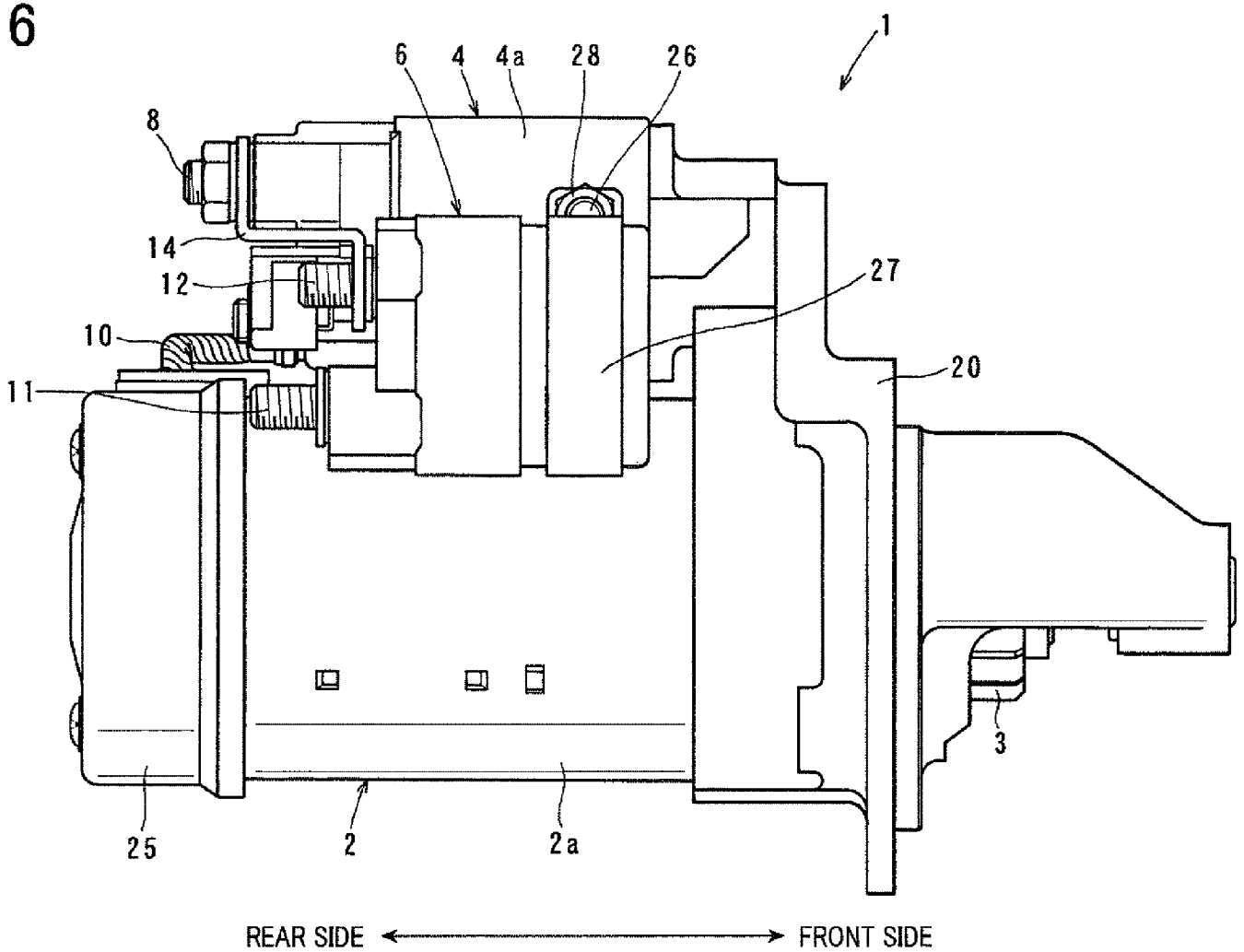
FIGS. 16 and 17 are respectively side and rear end views of a starter according to a modification of the fifth embodiment.
Figure 17:
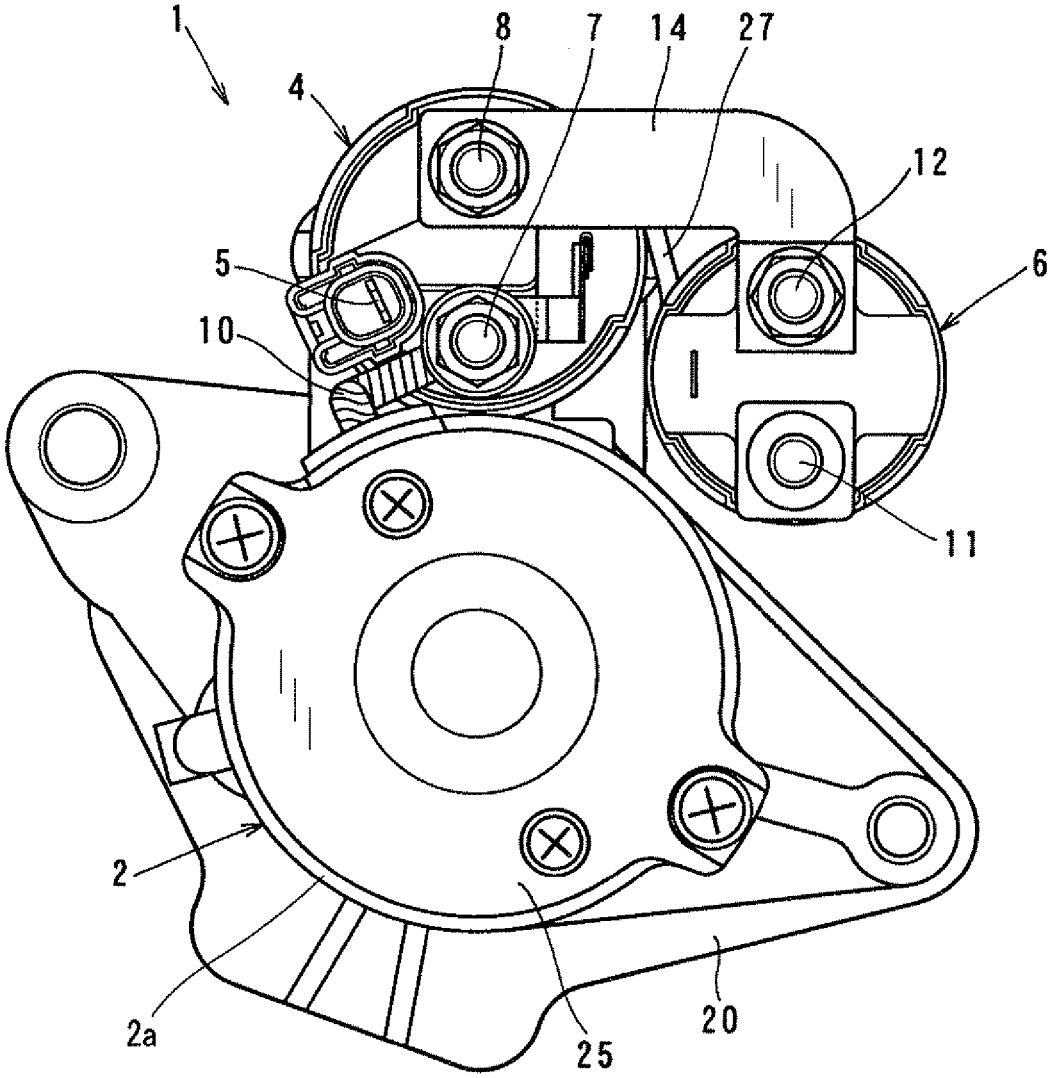

In the previous embodiment, the auxiliary electromagnetic switch 6 is fixed, via the fixing band 27, to the motor yoke 2*a*. However, as shown in FIGS. 16 and 17, it is also possible to fix the auxiliary electromagnetic switch 6, via the fixing band 27, to the yoke 4*a* of the main electromagnetic switch 4 in the same manner as fixing it to the motor yoke 2*a*. In this case, it is still possible to achieve the same advantages as described in the previous embodiment.

While the above particular embodiments and modifications have been shown and described, it will be understood by those skilled in the art that various further modifications, changes, and improvements may be made without departing from the spirit of the invention.

For example, in the first embodiment, as shown in FIG. 2, the auxiliary electromagnetic switch 6 is configured as a normally-closed switch; the resistor 60 is connected in parallel with the fixed contacts 61 and 62 of the auxiliary electromagnetic switch 6; and the main electromagnetic switch 4 is configured as a normally-open switch and connected in series with the auxiliary electromagnetic switch 6.

Figure 18:
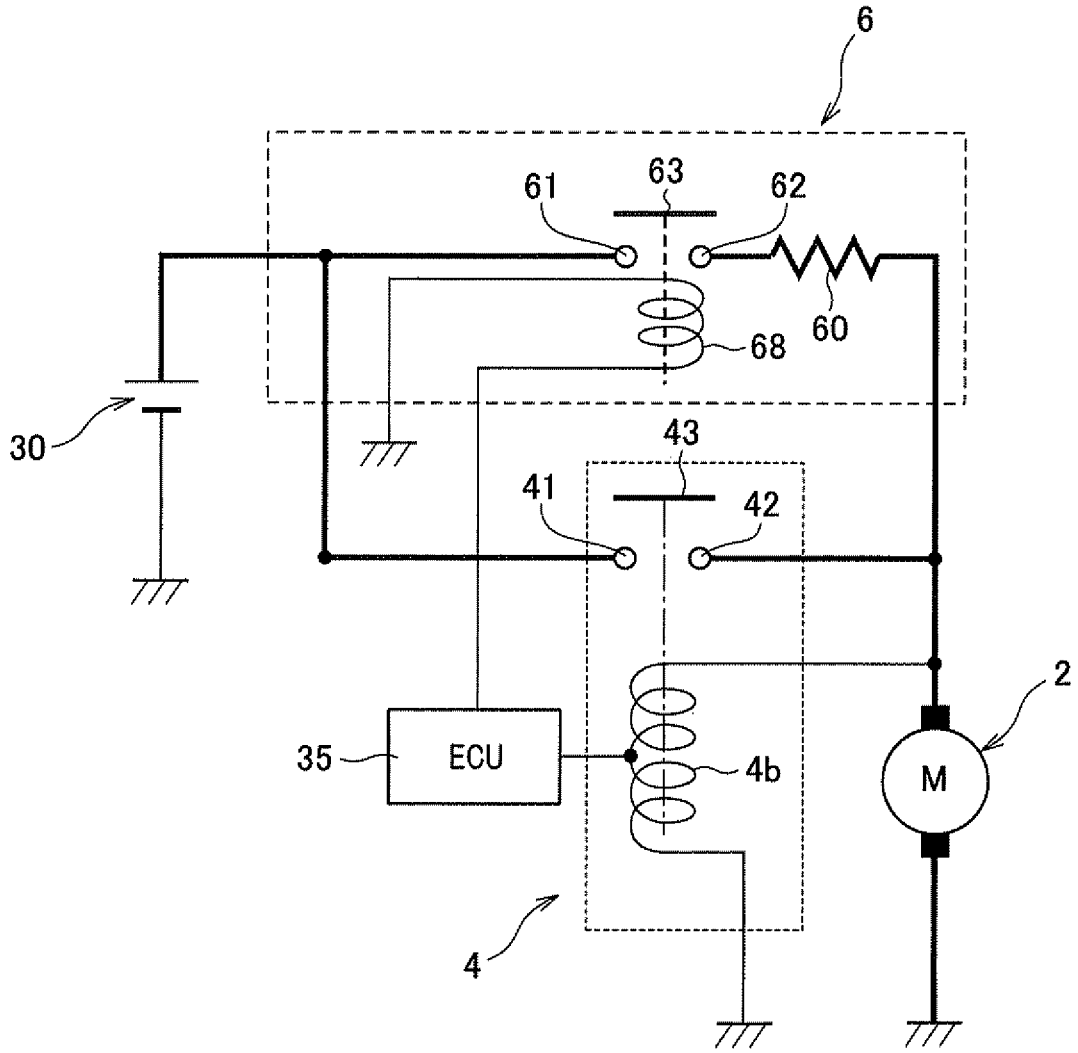
FIG. 18 is a schematic circuit diagram of a starter according to a modification of the first embodiment.

However, as shown in FIG. 18, it is also possible to: configure each of the main and auxiliary electromagnetic switches 4 and 6 as a normally-open electromagnetic switch; connect the resistor 60 in series with the fixed contacts 61 and 62 of the auxiliary electromagnetic switch 6; and connect the fixed contacts 61 and 62 of the auxiliary electromagnetic switch 6 together with the resistor 60 in parallel with the fixed contacts 41 and 42 of the main electromagnetic switch 4. In this case, electric power is supplied from the battery 30 to the motor 2 along the high-resistance path (i.e., through the resistor 60) when only the auxiliary electromagnetic switch 6 is closed, and along the low-resistance path (i.e., bypassing the resistor 60) whenever the main electromagnetic switch 4 is closed regardless of the auxiliary electromagnetic switch 6 being open or closed.

Moreover, in the fifth embodiment, the mount has the stud bolts 26 embedded therein so as to facilitate the fixing of the auxiliary electromagnetic switch 6 to the motor yoke 2*a* via the fixing band 27.

However, it is also possible to embed the nuts 28, instead of the stud bolts 26, in the mount. In this case, the auxiliary electromagnetic switch 6 may be fixed to the motor yoke 2*a* via the fixing band 27 as follows. First, the auxiliary electromagnetic switch 6 is placed on the mount provided on the radially outer surface of the motor yoke 2*a*. Then, the fixing band 27 is placed to surround the radially outer surface of the yoke 65 of the auxiliary electromagnetic switch 6, and the end portions of the fixing band 27 are positioned relative to the mount so as to bring each of the through-holes formed in the end portions into alignment with one of the nuts 28 embedded in the mount. Thereafter, for each aligned pair of the through-holes of the end portions and the nuts 28, a bolt is placed to extend through the through-hole and tightened into the nut 28 to fix the end portion to the mount.

What is claimed is:

1. A starter for starting an engine, the starter comprising:

a starter main body including a motor that includes a hollow cylindrical yoke and that generates torque upon being supplied with electric power;

a main electromagnetic switch configured to selectively open and close an electric circuit that supplies the electric power from a battery to the motor;

an auxiliary electromagnetic switch configured to selectively switch the electric circuit between a high-resistance path and a low-resistance path, the electric power being supplied from the battery to the motor through a resistor along the high-resistance path, and the electric power being supplied from the battery to the motor by bypassing the resistor along the low-resistance path; and a fixture to which the auxiliary electromagnetic switch is fixed, the fixture being fixed to only one of the starter main body and the main electromagnetic switch, wherein:

the fixture is configured as a fixing band that includes a band portion and a seat portion, the band portion having the shape of an incomplete hollow cylinder with an opposite pair of circumferential ends, the seat portion having (i) a pair of side walls that protrude radially outward respectively from the circumferential ends of the band portion and (ii) an end wall that extends to connect radially outer ends of the side walls, the band portion of the fixing band surrounds a radially outer surface of the yoke of the motor and is fixed to the radially outer surface, the auxiliary electromagnetic switch is fixed to an outer surface of the end wall of the seat portion of the fixing band, the band portion has an inside diameter greater than the outside diameter of the yoke of the motor and at least one tapped hole formed through a circumferential wall of the band portion, and the band portion is fixed to the radially outer surface of the yoke of the motor by a bolt tightened into the at least one tapped hole of the band portion to press the bolt against the radially outer surface of the yoke.

2. The starter as set forth in claim 1, wherein the at least one tapped hole is formed by burring.

3. The starter as set forth in claim 1, wherein:

the auxiliary electromagnetic switch includes a cylindrical cup-shaped yoke and a pair of brackets, each of the brackets is bent to have first and second portions, the first portion extending along and being joined to a radially outer surface of the yoke of the auxiliary electromagnetic switch, the second portion protruding from the radially outer surface of the yoke to constitute a supporting foot, and each of the supporting feet of the brackets is disposed on the outer surface of the end wall of the seat portion of the fixing band and fixed to the outer surface by a bolt-nut engagement.

4. The starter as set forth in claim 1, wherein:

the seat portion of the fixing band has a pair of slits that are formed through the end wall of the seat portion to extend parallel to each other with a predetermined distance therebetween, the auxiliary electromagnetic switch includes a cylindrical cup-shaped yoke and a pair of brackets, each of the brackets being bent to have first and second portions, the first portion extending along and being joined to a radially outer surface of the yoke of the auxiliary electromagnetic switch, the second portion protruding from the radially outer surface of the yoke to constitute a supporting foot, the supporting feet of the brackets extend parallel to each other with a predetermined distance therebetween, the predetermined distance between the supporting feet being substantially equal to that between the slits formed in the seat portion of the fixing band, each of the supporting feet of the brackets has a recess that is formed in an end surface of the supporting foot with a depth direction coinciding with an axial direction of the auxiliary electromagnetic switch, the recess having a width substantially equal to a thickness of the end wall of the seat portion of the fixing band, each of the supporting feet of the brackets is disposed to extend through a corresponding one of the slits formed through the end wall of the seat portion of the fixing band, and the end wall of the seat portion of the fixing band is press-fitted in each of the recesses formed in the supporting feet of the brackets.

5. The starter as set forth in claim 4, wherein for each of the supporting feet of the brackets, a protruding part of the supporting foot, which protrudes inside the end wall of the seat portion of the fixing band, is in pressed contact with the radially outer surface of the yoke of the motor.

6. A starter for starting an engine, the starter comprising:

a starter main body including a motor that generates torque upon being supplied with electric power;

a main electromagnetic switch that includes a cylindrical cup-shaped yoke and that is configured to selectively open and close an electric circuit that supplies the electric power from a battery to the motor;

an auxiliary electromagnetic switch configured to selectively switch the electric circuit between a high-resistance path and a low-resistance path, the electric power being supplied from the battery to the motor through a resistor along the high-resistance path, and the electric power being supplied from the battery to the motor by bypassing the resistor along the low-resistance path; and a fixture to which the auxiliary electromagnetic switch is fixed, the fixture being fixed to only one of the starter main body and the main electromagnetic switch, wherein:

the fixture is configured as a fixing band that includes a band portion and a seat portion, the band portion having the shape of an incomplete hollow cylinder with an opposite pair of circumferential ends, the seat portion having (i) a pair of side walls that protrude radially outward respectively from the circumferential ends of the band portion and (ii) an end wall that extends to connect radially outer ends of the side walls, the band portion of the fixing band surrounds a radially outer surface of the yoke of the main electromagnetic switch and is fixed to the radially outer surface, the auxiliary electromagnetic switch is fixed to an outer surface of the end wall of the seat portion of the fixing band, the band portion has an inside diameter greater than the outside diameter of the yoke of the main electromagnetic switch and at least one tapped hole formed through a circumferential wall of the band portion, and the band portion is fixed to the radially outer surface of the yoke of the main electromagnetic switch by a bolt tightened into the at least one tapped hole of the band portion to press the bolt against the radially outer surface of the yoke.

7. The starter as set forth in claim 6, wherein the at least one tapped hole is formed by burring.

8. The starter as set forth in claim 6, wherein:

the auxiliary electromagnetic switch includes a cylindrical cup-shaped yoke and a pair of brackets, each of the brackets is bent to have first and second portions, the first portion extending along and being joined to a radially outer surface of the yoke of the auxiliary electromagnetic switch, the second portion protruding from the radially outer surface of the yoke to constitute a supporting foot, and each of the supporting feet of the brackets is disposed on the outer surface of the end wall of the seat portion of the fixing band and fixed to the outer surface by a bolt-nut engagement.

9. The starter as set forth in claim 6, wherein:

the seat portion of the fixing band has a pair of slits that are formed through the end wall of the seat portion to extend parallel to each other with a predetermined distance therebetween, the auxiliary electromagnetic switch includes a cylindrical cup-shaped yoke and a pair of brackets, each of the brackets being bent to have first and second portions, the first portion extending along and being joined to a radially outer surface of the yoke of the auxiliary electromagnetic switch, the second portion protruding from the radially outer surface of the yoke to constitute a supporting foot, the supporting feet of the brackets extend parallel to each other with a predetermined distance therebetween, the predetermined distance between the supporting feet being substantially equal to that between the slits formed in the seat portion of the fixing band, each of the supporting feet of the brackets has a recess that is formed in an end surface of the supporting foot with a depth direction coinciding with an axial direction of the auxiliary electromagnetic switch, the recess having a width substantially equal to a thickness of the end wall of the seat portion of the fixing band, each of the supporting feet of the brackets is disposed to extend through a corresponding one of the slits formed through the end wall of the seat portion of the fixing band, and the end wall of the seat portion of the fixing band is press-fitted in each of the recesses formed in the supporting feet of the brackets.

10. The starter as set forth in claim 9, wherein for each of the supporting feet of the brackets, a protruding part of the supporting foot, which protrudes inside the end wall of the seat portion of the fixing band, is in pressed contact with the radially outer surface of the yoke of the main electromagnetic switch.

11. A starter for starting an engine, the starter comprising:

a starter main body including a motor that generates torque upon being supplied with electric power;

a main electromagnetic switch configured to selectively open and close an electric circuit that supplies the electric power from a battery to the motor;

an auxiliary electromagnetic switch configured to selectively switch the electric circuit between a high-resistance path and a low-resistance path, the electric power being supplied from the battery to the motor through a resistor along the high-resistance path, and the electric power being supplied from the battery to the motor by bypassing the resistor along the low-resistance path; and a fixture to which the auxiliary electromagnetic switch is fixed, the fixture being fixed to only the starter main body, wherein:

the fixture is configured as a mount that (i) is integrally formed with one of the starter main body and the main electromagnetic switch and (ii) has a mounting surface that is parallel to a line that is perpendicular to an axial direction of the starter, a normal of the mounting surface being parallel to the axial direction of the starter, the auxiliary electromagnetic switch includes a cylindrical cup-shaped yoke and a bracket that is joined to the outer surface of an end wall of the yoke, and the bracket is disposed on and fixed to the mounting surface of the mount.

12. The starter as set forth in claim 11, wherein the starter main body includes a housing, and the mount is integrally formed with the housing.

13. The starter as set forth in claim 11, wherein the motor includes a hollow cylindrical yoke and an end frame that closes an open end of the yoke, and the mount is integrally formed with the end frame.

14. A starter for starting an engine, the starter comprising:

a starter main body including a motor that generates torque upon being supplied with electric power;

a main electromagnetic switch configured to selectively open and close an electric circuit that supplies the electric power from a battery to the motor;

an auxiliary electromagnetic switch configured to selectively switch the electric circuit between a high-resistance path and a low-resistance path, the electric power being supplied from the battery to the motor through a resistor along the high-resistance path, and the electric power being supplied from the battery to the motor by bypassing the resistor along the low-resistance path; and a fixture to which the auxiliary electromagnetic switch is fixed, the fixture being fixed to only one of the starter main body and the main electromagnetic switch, wherein:

the fixture is configured as a mount that (i) is integrally formed with one of the starter main body and the main electromagnetic switch and (ii) has a mounting surface perpendicular to an axial direction of the starter, the auxiliary electromagnetic switch includes a cylindrical cup-shaped yoke and a bracket that is joined to the outer surface of an end wall of the yoke, the bracket is disposed on and fixed to the mounting surface of the mount, the main electromagnetic switch and the auxiliary electromagnetic switch are mechanically and electrically connected by a connecting member that is separate from the fixture, and the auxiliary electromagnetic switch is between the mount of the fixture and the connecting member.

* * * * *